United States Patent [19]

Reardon

[11] Patent Number: 4,580,632

[45] Date of Patent: Apr. 8, 1986

[54] WELL TOOL FOR TESTING OR TREATING A WELL

[75] Inventor: Daniel R. Reardon, Houston, Tex.

[73] Assignee: N. J. McAllister Petroleum Industries Inc., Canada

[21] Appl. No.: 553,117

[22] Filed: Nov. 18, 1983

[51] Int. Cl.[4] ..... E21B 33/122; E21B 49/08

[52] U.S. Cl. ..... 166/250; 166/106; 166/147; 166/186; 166/187; 166/191; 166/264

[58] Field of Search ..... 166/250, 264, 387, 147, 166/187, 191, 179, 101, 106, 120, 122, 127, 129, 183–186, 196, 134

[56] References Cited

U.S. PATENT DOCUMENTS

| | | | |
|---|---|---|---|
| 2,715,444 | 8/1955 | Fewel | 166/147 |
| 3,139,140 | 6/1964 | Brown | 166/134 |
| 3,288,219 | 11/1966 | Young et al. | 166/120 |
| 3,339,637 | 9/1967 | Holden | 166/120 |
| 3,439,740 | 4/1969 | Conover | 166/250 |
| 4,320,800 | 3/1982 | Upchurch | 166/106 |
| 4,457,367 | 7/1984 | Brandell | 166/105 |

*Primary Examiner*—James A. Leppink
*Assistant Examiner*—Hoang C. Dang
*Attorney, Agent, or Firm*—Mason M. Campbell

[57] ABSTRACT

A testing or treating tool enables either squeeze packer elements or inflatable packer elements to isolate an interval of the well bore. A pump provides hydraulic pressure to move the packer elements into sealing engagement with the well bore wall by manipulation of a tubular member which supports the tool in the well bore. The tool includes a sensor which is responsive to a pressure differential between the hydrostatic pressure in the well bore and the pressure in the isolated zone, or interval, in the well to increase the hydraulic pressure acting on the elements when the pressure in the well bore exceeds the pressure in the isolated zone to inhibit creep of the packers along the well bore wall. A collection reservoir receives fluid displaced from the well bore as the packers sealably engage the well bore.

37 Claims, 34 Drawing Figures

WELL TOOL FOR TESTING OR TREATING A WELL

BACKGROUND OF THE INVENTION

1. Field of the Invention

The field of this invention relates generally to testing and treating tools which may be run into the well on a well string or a drill string and which includes a packer assembly incorporating one or more, and generally more, elements which are spaced and can be expanded by manipulation of the well string or drill string on which the tool is run into the well bore so that the packer element or packer elements may be sealingly engaged with the well bore wall and isolate a zone therein for conducting tests or treatment.

2. Description of the Prior Art

The prior art is generally constructed as above described, but with the packer elements being of the inflatable type. Prior to this invention, it was apparently not considered generally feasible or practical to employ squeeze packer elements in a testing or treating well tool of the type to which the present invention relates.

Further, so far as known to Applicant, the prior art discloses no arrangement for maintaining the expanded elements, inflatable or squeeze, in position with the well bore wall under varying pressure circumstances that might occur during use of the tool. In some circumstances, varying pressure conditions have caused the packer elements to move or creep along the well wall when sealingly engaged therewith. Also, the prior art testing apparatus such as shown in U.S. Pat. No. 3,439,740 issued to G. E. Conover shows a construction employing inflatable elements which are expandable by a pump incorporated in the tool which is actuated by rotation of the pipe string or drill string that extends from the earth's surface and on which the tool is supported. In U.S. Pat. No. 4,320,800, issued to James M. Upchurch, one of the inflatable packer elements is inflated by rotation of the pipe string and the other inflatable packer element is inflated in response to upward and downward movement of the pipe string.

SUMMARY OF THE INVENTION

An object of the present invention is to provide in a well tool adapted to be lowered on a tubular member in a well bore and wherein the tool includes spaced packer elements with pump means operable in response to movement of the tubular member for providing hydraulic pressure to urge the packer elements to sealingly engage the well bore wall, sensing means operable in response to a pressure differential between the hydrostatic pressure in the well bore and the pressure in the isolated zone between the elements when sealingly engaged with the well bore wall to increase the hydraulic pressure acting on the elements.

A further object of the present invention is to provide in a well tool adapted to be lowered on a tubular member in a well bore and wherein the tool includes spaced squeeze packer elements with pump means operable in response to movement of the tubular member for providing hydraulic pressure to urge the packer elements to sealingly engage the well bore wall, sensing means operable in response to a pressure differential between the hydrostatic pressure in the well bore and the pressure in the isolated zone between the elements when sealingly engaged with the well bore wall to increase the hydraulic pressure acting on the elements.

Yet a further object of the invention is to provide a well tool adapted to be lowered on a tubular member in a well bore and including packer means with pump means operable in response to movement of the tubular member for providing hydraulic pressure to urge the packer means to sealingly engage the well bore wall and isolate a zone in the well, means to maintain the hydraulic pressure which urges the elements into well bore wall sealing engagement above the hydrostatic pressure in the well bore to inhibit creep or movement of the packer means along the well bore wall.

Still another object of the present invention is to provide a method of testing or treating a well bore comprising the steps of lowering a tubular member with a tool having one or more packer elements thereon into a well bore to isolate a zone in the well bore, moving the tubular member to create a hydraulic pressure to expand and urge the packer element to sealingly engage the well bore wall for isolating a zone in the well bore, comparing the well bore pressure with the pressure in the isolated well zone, and increasing the hydraulic pressure acting on the element when the pressure in the well bore exceeds the pressure in the isolated well zone.

Another object of the present invention is the above method including the step of collecting fluid displaced from the isolated zone as the element expands to sealingly engage the well bore wall.

Other objects and advantages of the present invention will become apparent from a consideration of the following drawings and description.

DESCRIPTION OF THE PREFERRED EMBODIMENT

Figure 1:
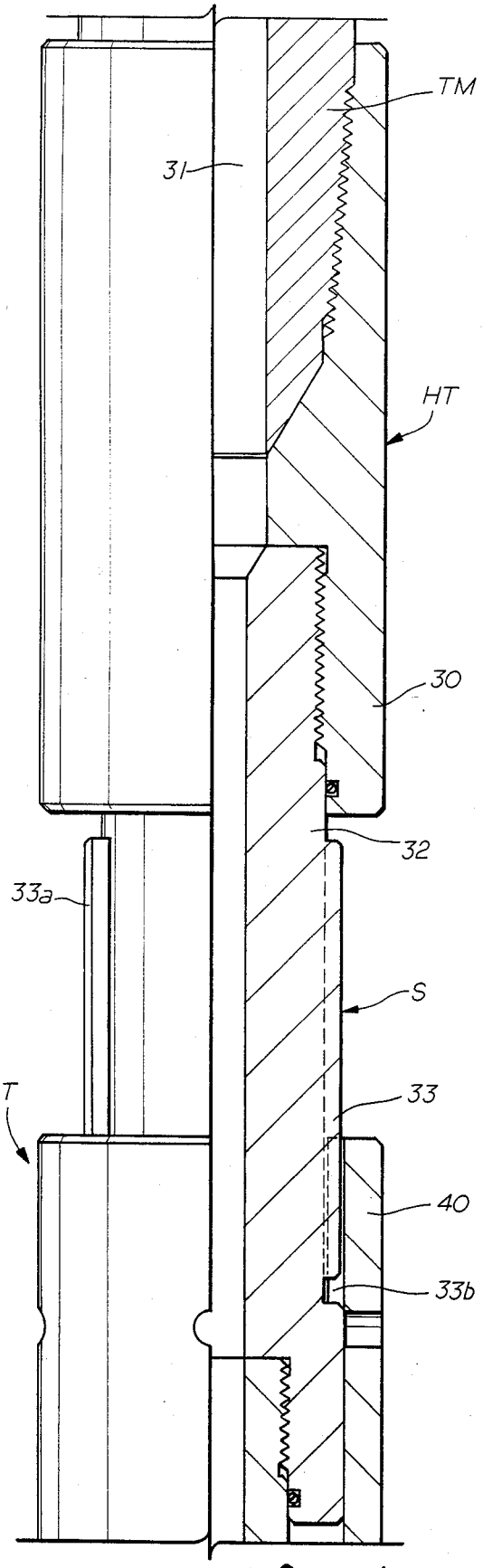
FIG. 1 is a one-quarter sectional view of the upper end of the tool.

Attention is first directed to FIG. 1 of the drawings wherein a device commonly referred to as a hydraulic tool (HT) is shown as being telescopically received in the upper end of the upper outer housing 40 of the tool of the present invention. The HT is shown as including a coupling 30 having threads 31 adjacent its upper end for connection with a well string or drill string designated TM whereby the tool T of the present invention may be lowered into and supported for use in a well. A sub 32 is threaded to the lower end of the coupling 30, and it and the upper end of upper housing 40 are provided with a spline arrangement S to accommodate relative longitudinal movement between 30, 32 and 40. The construction and arrangement of spline S is well known to those skilled in the art. The spline arrangement S includes the longitudinally extending, circumferentially spaced ribs 33*a* which fit in circumferentially spaced, longitudinal grooves 33*b* within the outer housing 40 whereby rotation may be imparted to the outer housing 40 by the well string TM for a purpose as will be described.

Figure 3:
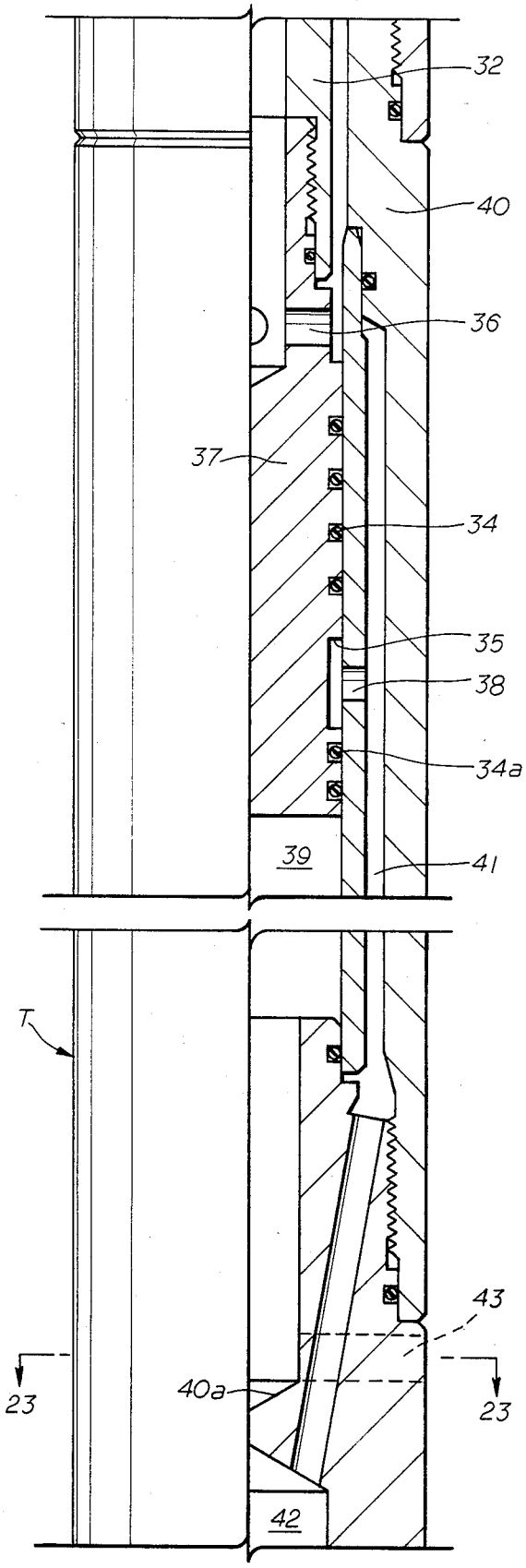
FIG. 3 is a continuation of FIG. 2 and illustrates a valve means for controlling communication between the well string and the tool.
Figure 4:
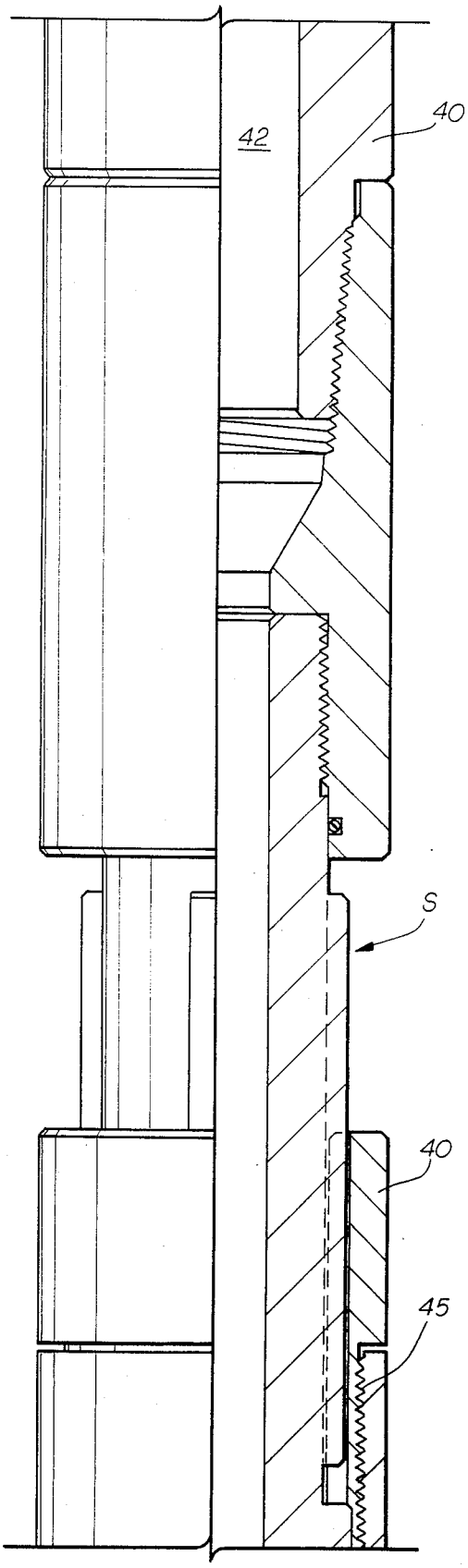
FIG. 4 is a continuation of FIG. 3 and illustrating one of the splines to accommodate rotation of the well string for actuation of the pump.
Figure 5:
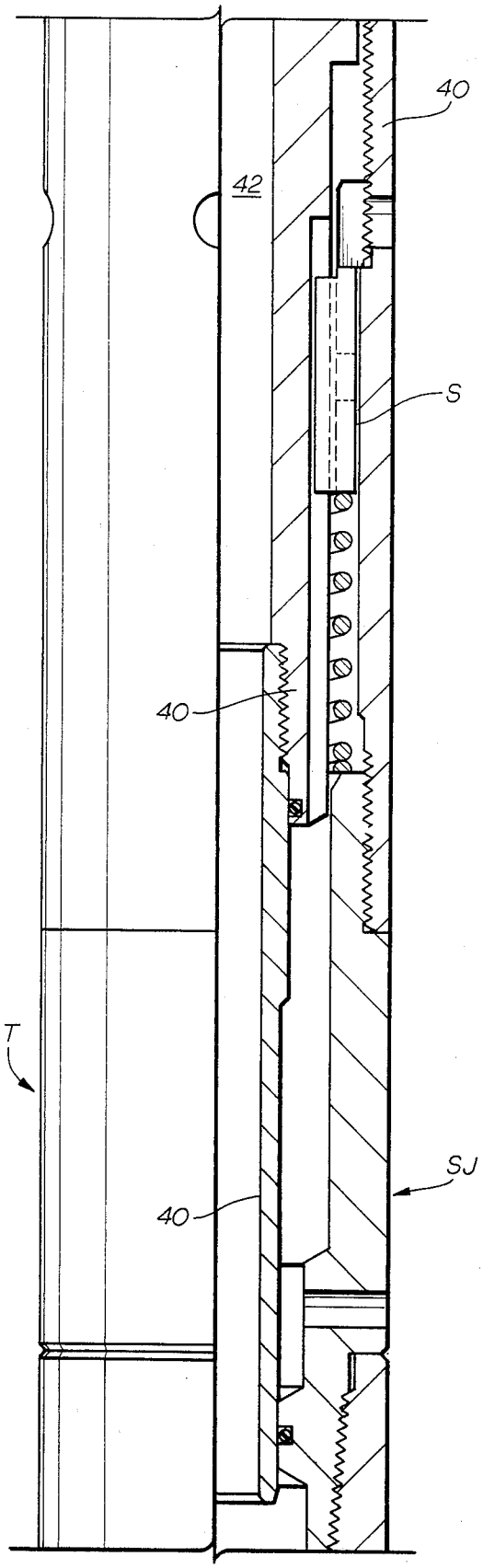
FIG. 5 is a continuation of FIG. 4.
Figure 7:
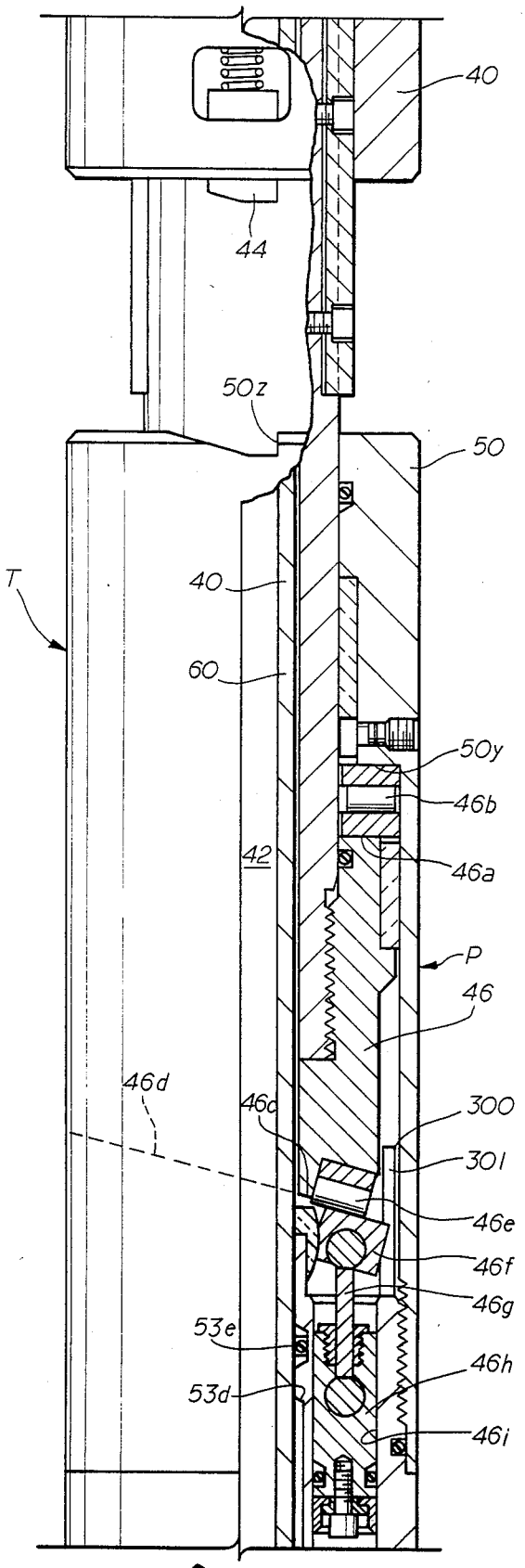
FIG. 7 is a continuation of FIG. 6, partly broken away, and illustates a means to actuate a safety joint.

The sub 32 includes additional sections as desired, and terminates within the outer housing 40 with its lower end closed off as shown at 37 as shown in FIG. 3. It will be noted that the closed lower end portion 37 of the sub 32 is provided with spaced seals 34, 34*a* for sealingly engaging with the interior of the outer housing 40 as shown, which spaced seals 34, 34*a* are provided on each side of the annular cavity 35 in the outer surface of 32 between the seals 34, 34*a* as shown in FIG. 3. Port means 36 are provided in the sub 32 above the closed lower end 37 and the spaced seals 34, 34*a* thereof for alignment with the ports 38 in housing 40 to enable the well string or drill string TM to be communicated when desired with the tool T beneath the HT. To this end, it will be noted that the housing 40 is provided with a longitudinally extending, annular passage 41 in housing portion 40 which communicate with the bore 42 of the tool T extending longitudinally of the outer housing 40 as shown. Ports 43 in housing 40 above the barrier 40*a*, which closes off the upper end of passage 42, communicate the well bore surrounding the housing 40 with the chamber or bore 39 in which the closed end 37 of the hydraulic tool shifts. The ports provide free fluid communication between chamber 39 and the well bore to inhibit formation of a hydraulic lock and thus permit longitudinal movement of the sub 32 and its closed end 37 to align the port 36 with the port 38 for receiving a test sample, or for accommodating the passage of treating fluid to the isolated zone in the well bore as will be described. In FIGS. 4, 5 and 7, spline arrangements represented by the letter S are provided to assist in transmitting torque of the well string TM for operation of the pump P as will be described.

A chamber 190 is formed by suitable seal means between the housing 40 and the member 32, and the chamber is provided with fluid. This arrangement restrains rapid or free fall of the hydraulic tool HT relative to the outer housing portion 40 but permits unrestrained upward movement relative thereto.

Figure 6:
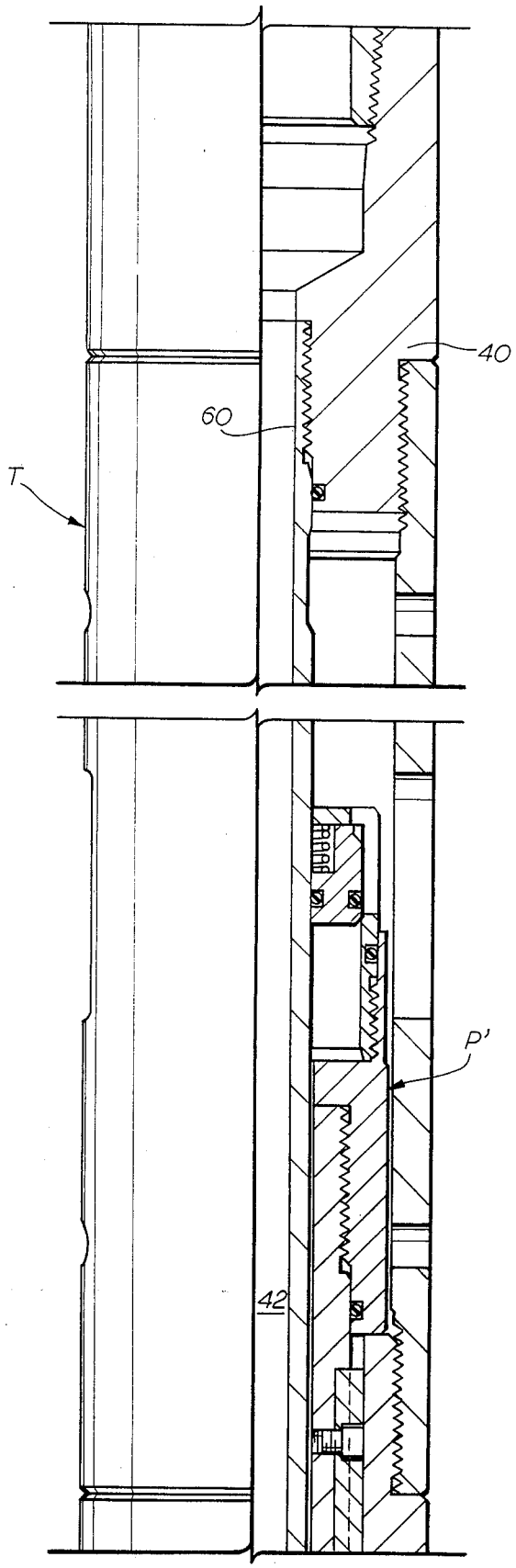
FIG. 6 is continuation of FIG. 5 and illustrates the upper end of the pump means.
Figure 9:
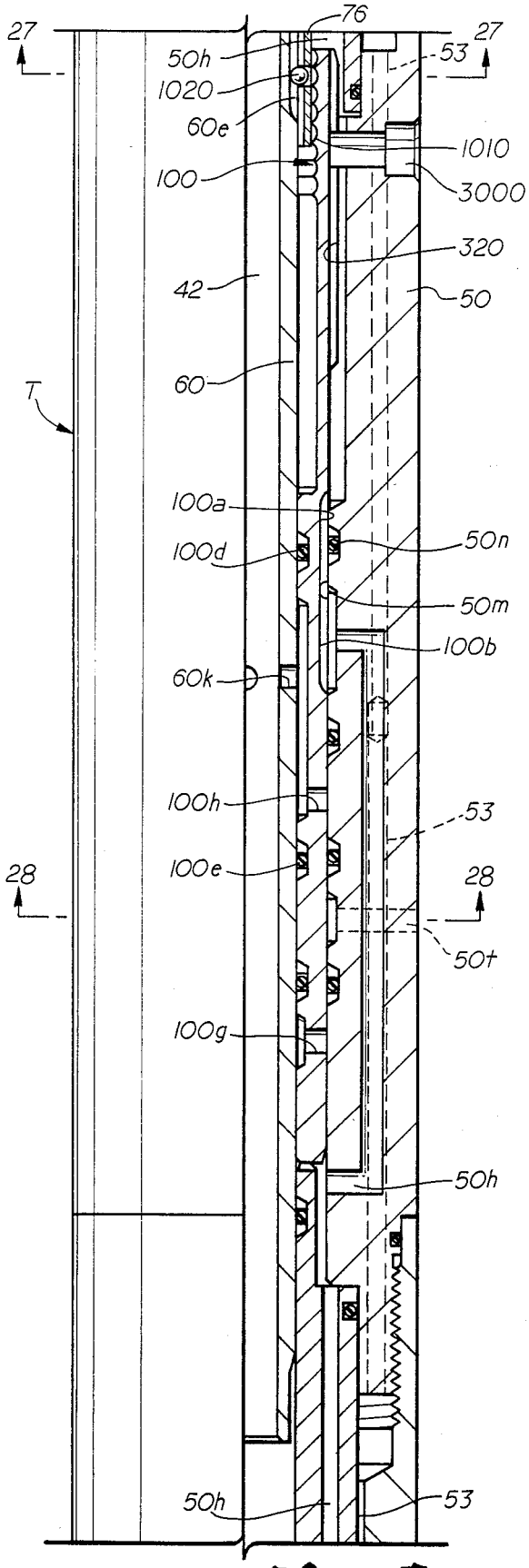
FIG. 9 is a continuation of FIG. 8 and illustrating a form of sleeve valve means which can be manipulated for performing various operations.

The upper housing portion 40 is shown as being telescopically received within the next housing portion 50 of the tool T as shown in FIG. 7. More specifically, as shown in FIG. 6, a mandrel or tube 60 is connected to the housing portion 40 and is spaced radially therefrom to provide a chamber for receiving the upper end portion P′ of the pump P as shown in FIGS. 6 and 7. The mandrel 60 and housing portion 40 telescopically receive the pump end portion P′ and the mandrel 60 extends through the pump P and shifting sleeve 100 to terminate in outer housing 50 as shown in FIG. 9. When the tubular member or well string TM is lowered, mandrel 60 is also lowered.

A safety joint is schematically referred to by the letters SJ in FIG. 5. Any suitable type safety joint may be employed which enables the well string to be disconnected from the tool T if any condition should require such disconnection. To accomplish this, the upper housing portion 40 is lowered so that the spring loaded lug 44 on housing 40 as shown in FIG. 7 engages in the groove 50z in the end of housing portion 50 so that left-hand rotation of the well string TM effects separation of the well string from the tool T at the left-hand threaded connection 45 shown at the lower end of FIG. 4.

The pump P as shown in FIG. 7 includes annular enlargement forming a rotor 46 on the lower end portion of the upper housing portion 40. The upper end 46a of the enlargement receives and positions the roller bearing means 46b between the end 46a of the enlargement and the shoulder 50y on housing portion 50 as shown in FIG. 7. The lower end 46c of the rotor 46 is inclined at an angle to provide a cam surface 46d on which is mounted a plurality of circumferentially spaced roller bearing means 46e.

The roller bearing means 46e engage a wobble plate 46f which has connected therewith a plurality of circumferentially spaced piston rods 46g, and the piston rods in turn each have secured therewith piston means 46h as shown. Each piston 46h is received in a cylinder 46i formed in the housing portion 50 and circumferentially spaced therein. While only one cylinder and piston is shown, it will be understood that there are a plurality of circumferentially spaced cylinders in the housing 50 with a corresponding number of pistons carried by the wobble plate 46f.

Figure 8:
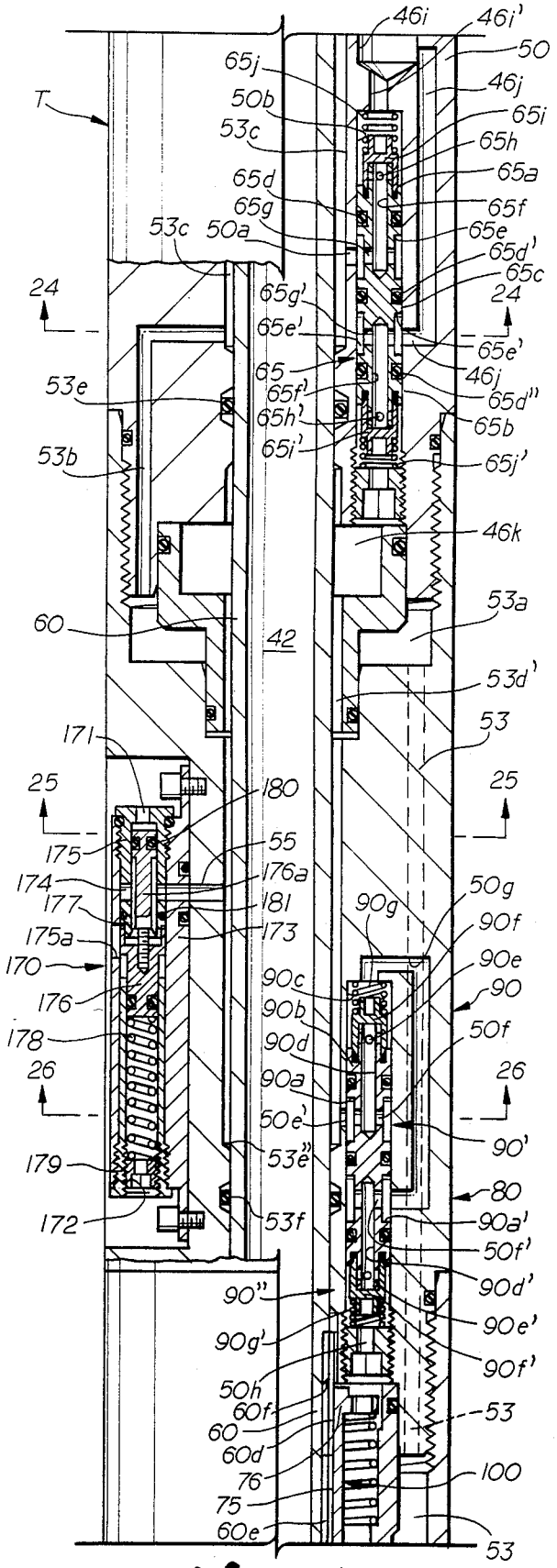
FIG. 8 is a continuation of FIG. 7, part of which is in half section for illustrating in greater detail the intake to the pump and the regulating valve for the hydraulic pressure system which actuates the packer elements.
Figure 10:
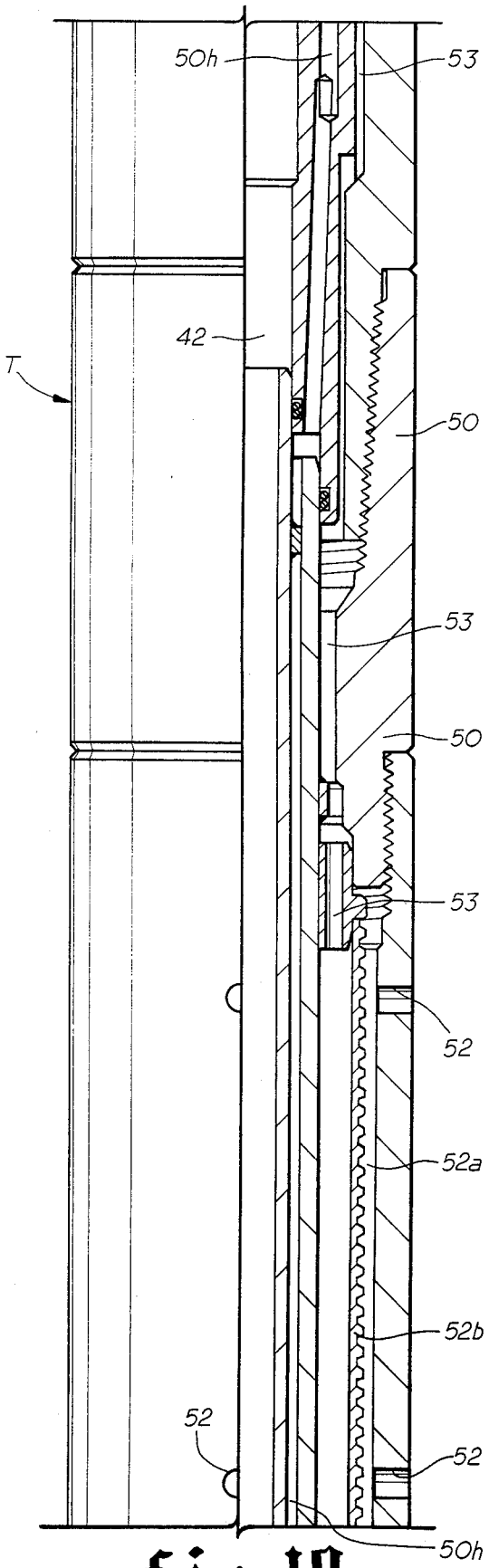
FIG. 10 is a continuation of FIG. 9.
Figure 11:
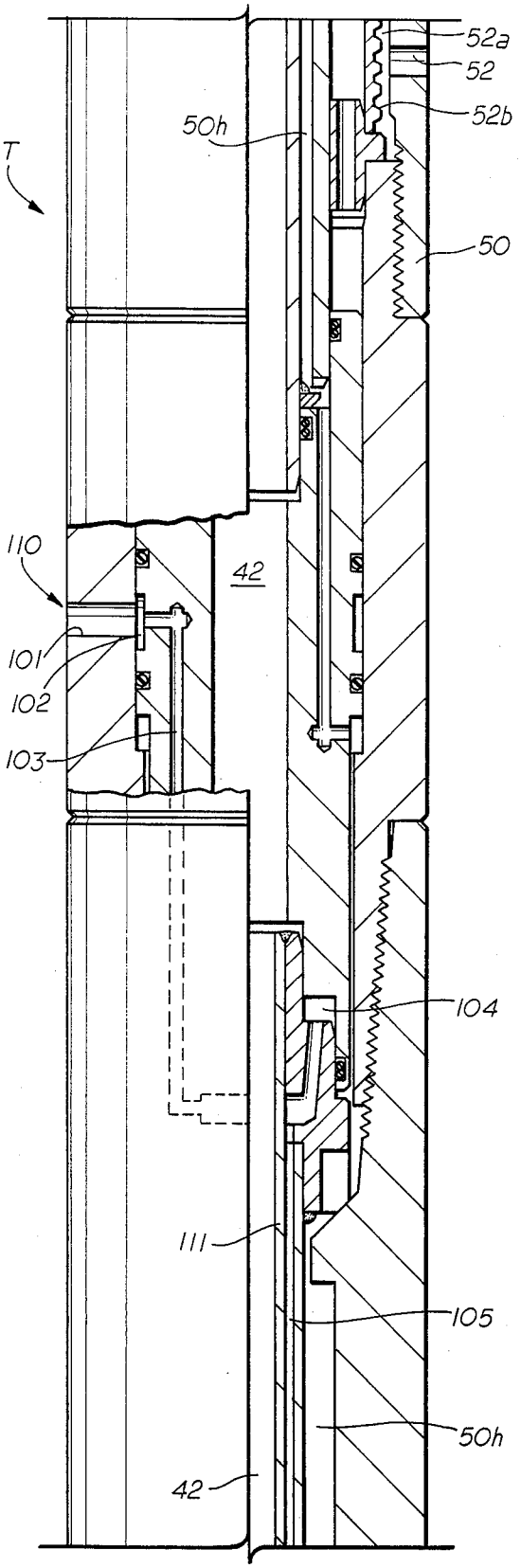
FIG. 11 is a continuation of FIG. 10, but partially broken away to illustrate a bypass port and passage arrangement above the upper packer element for communicating fluid to the interior of the tool and for communicating the well bore pressure above the uppermost packer to the well bore beneath the lowermost packer.

Attention is next directed to FIGS. 10 and 11 wherein the outer housing portion 50 is shown as being provided with ports 52 therein for communicating the well bore with the chamber 52a in the outer housing portion 50. A screen 52b is secured in the chamber 52a and extends circumferentially and longitudinally thereof as shown in FIGS. 10 and 11 to act as a filter. The ports 52 communicate well bore fluid to the longitudinally and circumferentially extending chamber 52a where it passes through the screen 52b for transmittal through the passage 53 formed in the outer housing portion 50 to the intake side of the cylinders 46i (FIG. 8) of the pump P as will be described. The passage 53 communicates with an annular chamber 53a formed in the outer housing portion 50 as shown in FIG. 8 and then through the passage 53b, which communicates with the annular chamber 53a as shown, to the annular void 53c between the mandrel 60 and the outer housing portion as shown in FIG. 8. The annular void 53c terminates at 53d as shown in FIG. 7. Seal means 53e are provided adjacent each end of the annular void 53c to inhibit leakage of fluid therefrom.

Figure 25:
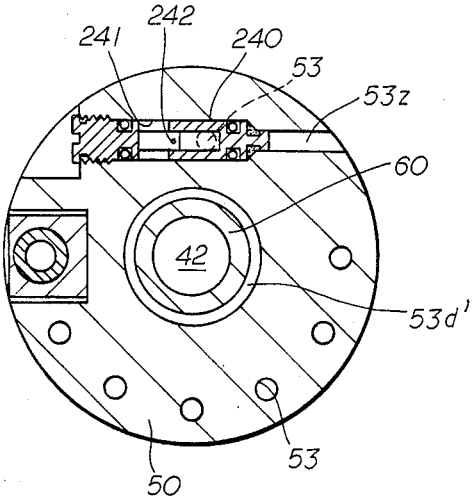
FIG. 25 is a sectional view on the line 25—25 of FIG. 8.
Figure 26:
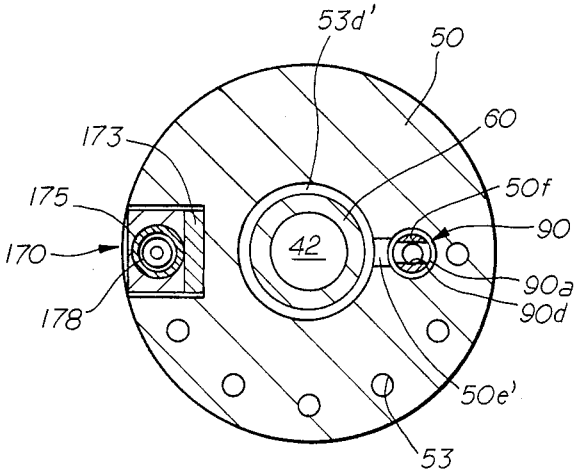
FIG. 26 is a sectional view on the line 26—26 of FIG. 8.
Figure 27:
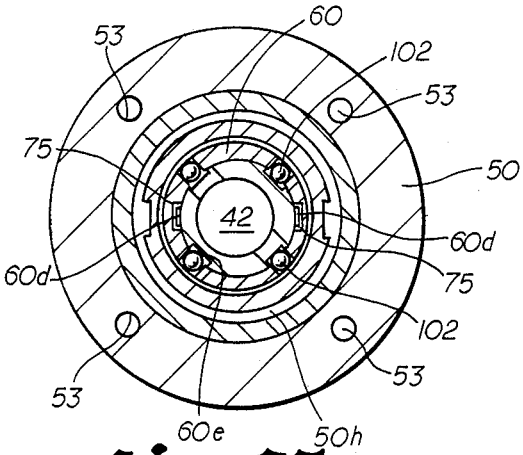
FIG. 27 is a sectional view on the line 27—27 of FIG. 9.
Figure 28:
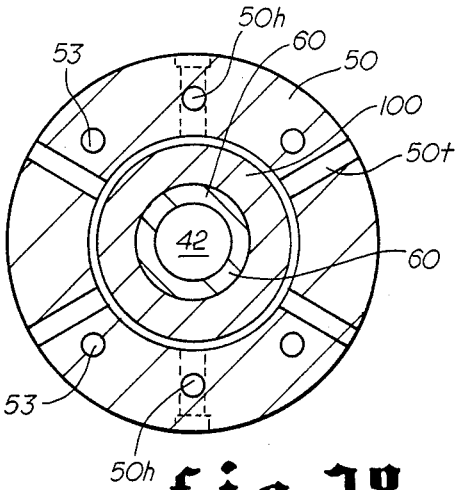
FIG. 28 is a sectional view on the line 28—28 of FIG. 9.
Figure 29:
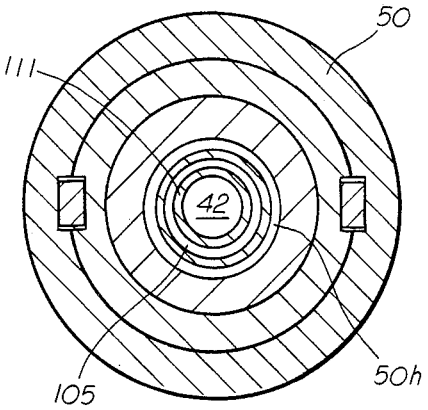
FIG. 29 is a sectional view on the line 29—29 of FIG. 13.
Figure 30:
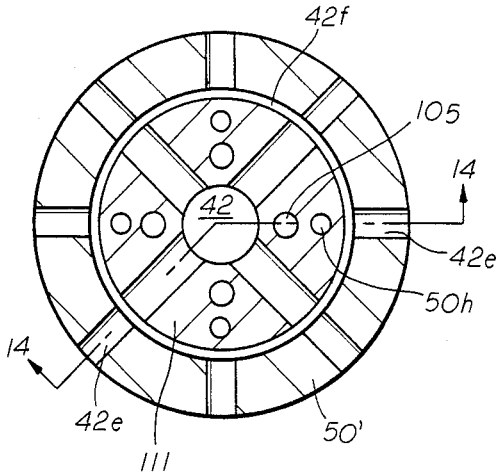
FIG. 30 is a sectional view on the line 30—30 of FIG. 14.

In the sectional view, FIG. 25, a valve 240 is positioned in bore 241 which connects with passage 53 between annular chamber 53a (FIG. 8) and annular chamber 52a (FIG. 10). If the screen 52b clogs, the pump suction causes shear pin 242 to shear and thus moving valve 240 to open passage 53 to the well bore through port 53z. This enables the screen 52b to be bypassed if it clogs.

The fluid in annular void 53c communicates through the port 50a in outer housing portion 50 with check valve chamber 50b formed in outer housing portion 50 as shown in FIG. 8. A double acting check valve means referred to generally by the numeral 65 is positioned in the check valve chamber 50b and includes an intake check valve 65a and a discharge check valve 65b. The check valve 65 may be constructed in any suitable manner and is shown as including a longitudinally extending stem 65c having suitable seal means 65d, 65d' and 65d'' for sealing between the stem 65c and the longitudinally extending chamber 50b in which the stem 65c is received to aid in separating the intake pump fluid from the discharge pump fluid and to properly seal the check valves 65a and 65b for operation. The body 65c also includes the annular cavities 65e, 65e' one of which communicates with the port 50a in outer housing portion 50 and the other of which communicates with cylinder discharge passage 46j as shown. Seals 65d, 65d' on each side of cavity 65e and seals 65d', 65d'' on each side of cavity 65e' seal between body 65c and chamber 50b. The body 65c includes a first longitudinally central passage 65f in stem 65c which communicates with intake port 50a and the annular cavity 65e by means of the port 65g' in body 65c. A port 65h adjacent one end of the longitudinal passage 65f in stem 65c communicates with chamber 50b above seal 65d and a check valve cover 65i is urged to seating position on the top of stem 65c by the spring 65j to cover the port 65h.

A second longitudinally extending passage 65f' is provided in the other end of body 65c which communicates adjacent one end with the cylinder discharge passages 46j through the annular cavity 65e' and port 65g' in body 65c as shown in FIG. 8. Port means 65h' are provided in body 65c which communicate with the longitudinal passage 65f' and a check valve cover 65i' is urged to seating position on body 65c to cover the port 65h' by means of the spring 65j'.

The discharge passage 46j communicates through check valve 65b with annular chamber 46k formed in any suitable manner as shown in FIG. 8 of the drawings in the outer housing portion 50. An annular longitudinally extending cavity 53d' formed between the mandrel 60 and outer housing portion 50 communicates with the chamber 46k to conduct pump discharge fluid to the regulator valve means referred to generally at 170 and to the master check valve referred to generally at 80. The annular cavity or void 53d' terminates as shown at 53e'' in FIG. 8 with suitable seal means 53f therebeneath to inhibit leakage from the void or cavity 53d'.

The pressure regulator valve 170 is exposed at both ends 171 and 172 to well bore fluid and is communicated with hydraulic pressure fluid discharged from the pump P by means of the passage 55 which extends through the outer housing portion 50 and through the regulator valve mounting plate 173 to communicate with port 174 formed in regulator valve body 175. The regulator valve 170 includes a valve element 176 that is urged to seating postion against fixed annular valve seat 177 by means of the spring 178. An extension 176a is secured to the movable valve element 176 and extends up in valve housing 175 as shown. The spring 178 abuts the valve element 176 at one of the spring ends and rests on the threaded, ported Allen 179 at its outer end. The Allen nut 179 can be adjusted to compress or relieve spring 178 to thereby control the pressure of the hydraulic fluid on the discharge side of the pump P and in the hydraulic system. Due to the relative diameter of the seals 180, 181 on the movable valve element 176 and the annular valve seat 177, the regulator valve will be forced open to discharge fluid through the port 175a in housing 175 if the pump pressure in the hydraulic discharge cavity 53d' exceeds the desired pressure as determined by adjustment of spring 178. When the excessive pressure in cavity 53d' moves the valve element 176 down, hydraulic pressure may be discharged from the regulator valve through the port 175a to the well bore. The ported Allen screw and port 171 permit well bore fluid to communicate beneath and above element 176 to avoid a hydraulic lock.

The master check valve 90 is similar in construction to the check valve 65 previously described in that it provides check valves 90' and 90'', and the pump discharge fluid from the cavity 53d' is discharged through port 50e' in housing 50 to the annular cavity 90a formed on stem 90b which extends longitudinally of master check valve chamber 90c formed in outer housing portion 50. The annular cavity 90a communicates through port 50f in stem 90b with longitudinally extending passageway 90d extending centrally of the upper end of stem 90b. The passageway 90d communicates through port 90e with passage 50g in outer housing portion 50 as shown in FIG. 8. A check valve cover 90f is urged towards seating position on one end of the stem 90b to cover port 90e by means of the spring 90g.

The hydraulic pressure fluid in passage 50g is communicated to check valve 90'' which includes annular cavity 90a' in stem 90b, port 50f' and passage 90d'. The fluid is conducted from cavity 90a' through port 50f' to longitudinally extending central passage 90d' which in turn communicates with port 90e' formed in the stem and communicating with passage 90d' as shown in the drawings. A check valve cover 90f' is seated on the end of the stem and is urged to a position to normally close off the port 90e' by means of the spring 90g'.

Figure 20:
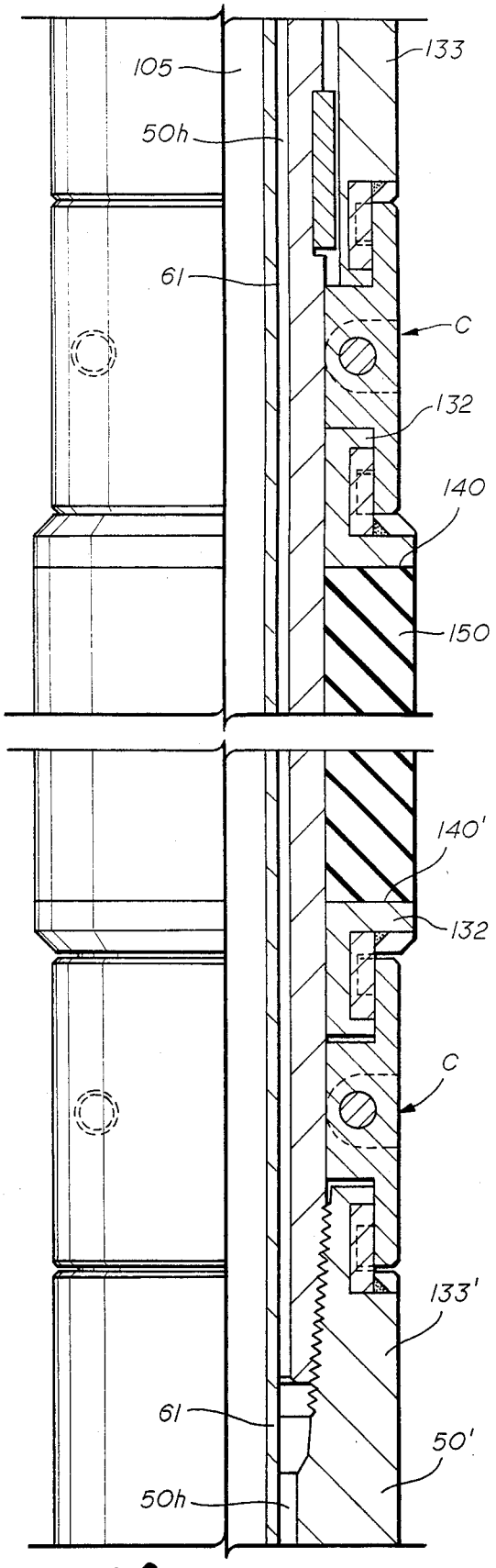
FIG. 20 is a continuation of FIG. 19 and illustrates the lowermost of the spaced packer elements.
Figure 21:
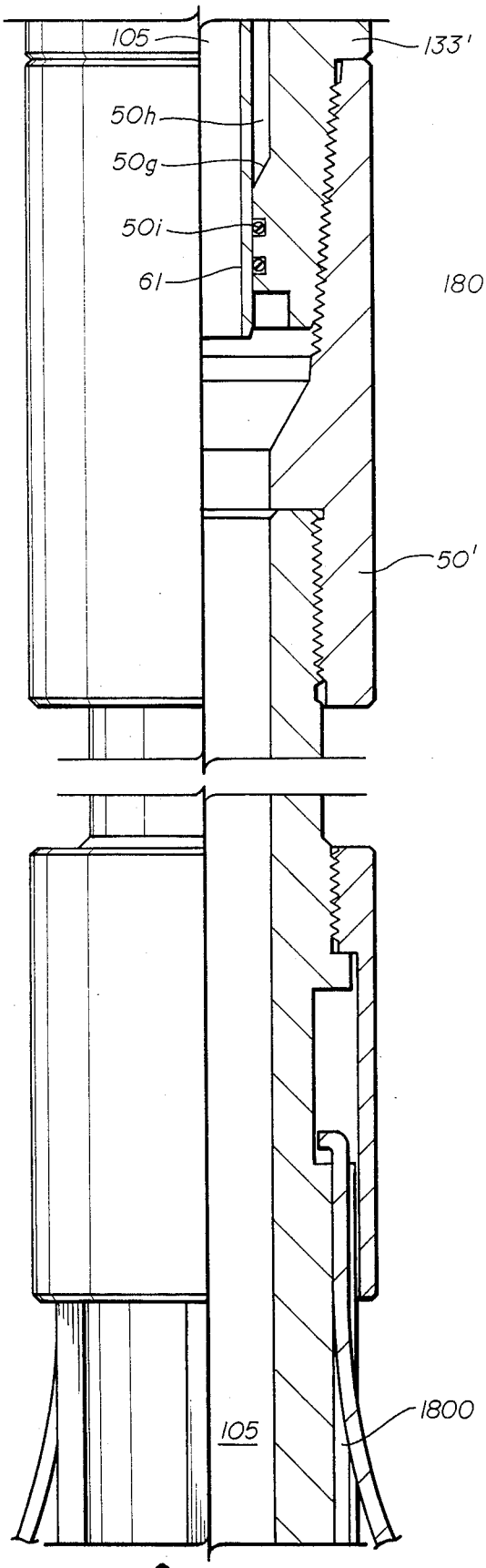
FIG. 21 is a continuation of FIG. 20 and illustrates the upper end of the bow spring means to restrain rotation of a portion of the tool when the well string or drill string is rotated to actuate the pump.

Hydraulic fluid discharged from the second check valve 90'' in master check valve 90 is conducted to the passage 50h in which is arranged the sliding or shifting sleeve valve arrangement 100, and which will be described in greater detail hereinafter. The hydraulic pressure fluid passage 50h continues through passage 50h in the tool T as shown in FIGS. 8–21 inclusive to terminate at 50g as shown in FIG. 21. Suitable seal means 50i are provided between the outer housing 50 and the tube 61 and any suitable means are provided to retain tube 61 in position in housing 50.

Figure 17:
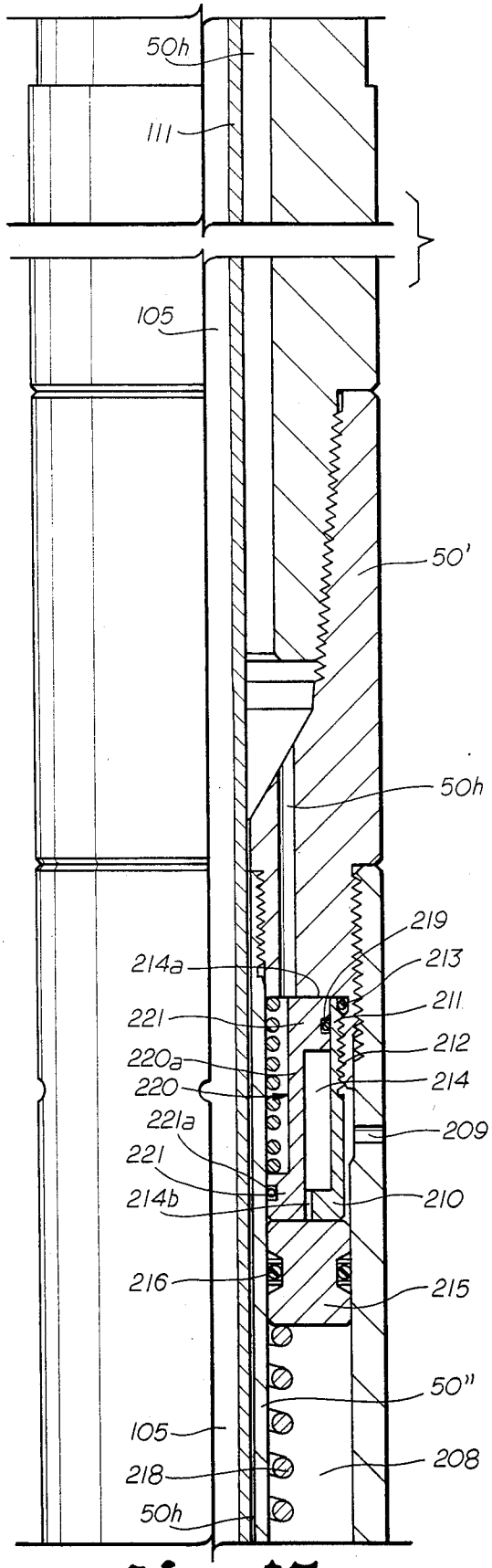
FIG. 17 is a continuation of FIG. 16 and illustrates in greater detail means to receive fluid displaced or discharged from between the packers as they sealingly engage with the well bore wall and means to maintain the hydraulic pressure acting on the elements above the pressure in the space between the elements when sealingly engaged with the well bore wall.
Figure 18:
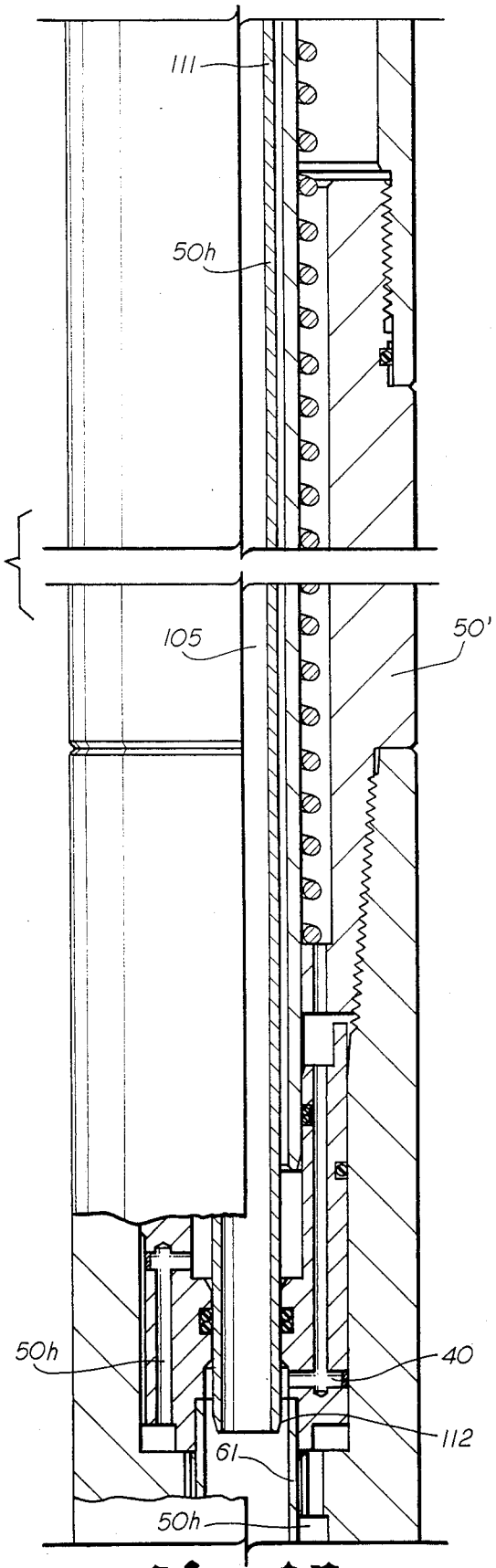
FIG. 18 is a continuation of FIG. 17.

Fluid bypass means are provided in the tool T for bypassing fluid, or communicating fluid, above and below the packer elements at all times. Attention is directed to FIG. 11 wherein such bypass means is referred to generally by the numeral 110. Port 101 extends through the outer housing body portion 50 to communicate with annular cavity 102. Fluid passage means 103 formed in the outer housing 50 extend as diagrammatically illustrated in FIG. 11 to communicate with the port 101, with annular cavity 104 and the passage 105 in the tool T. The passage 105 is formed by the tube 111 which extends longitudinally of the tool T as shown in FIG. 11 to terminate at 112 as shown in FIG. 18 within tube 61. The tube 111 is constructed and arranged in any suitable manner in housing 50 as demonstrated in the drawings to provide separate longitudinal passages as required and demonstrated by passages 42, 50h, 53 and 105. Fluid from the well bore above the upper packer 130 (FIG. 13) may be conducted through the port 101 and the passage 103 to the chamber 104 and then to passage 105 for communication with the well bore beneath the lowermost packer element 150 at the lower open end of the tool T as shown in FIGS. 11–22.

Figure 15:
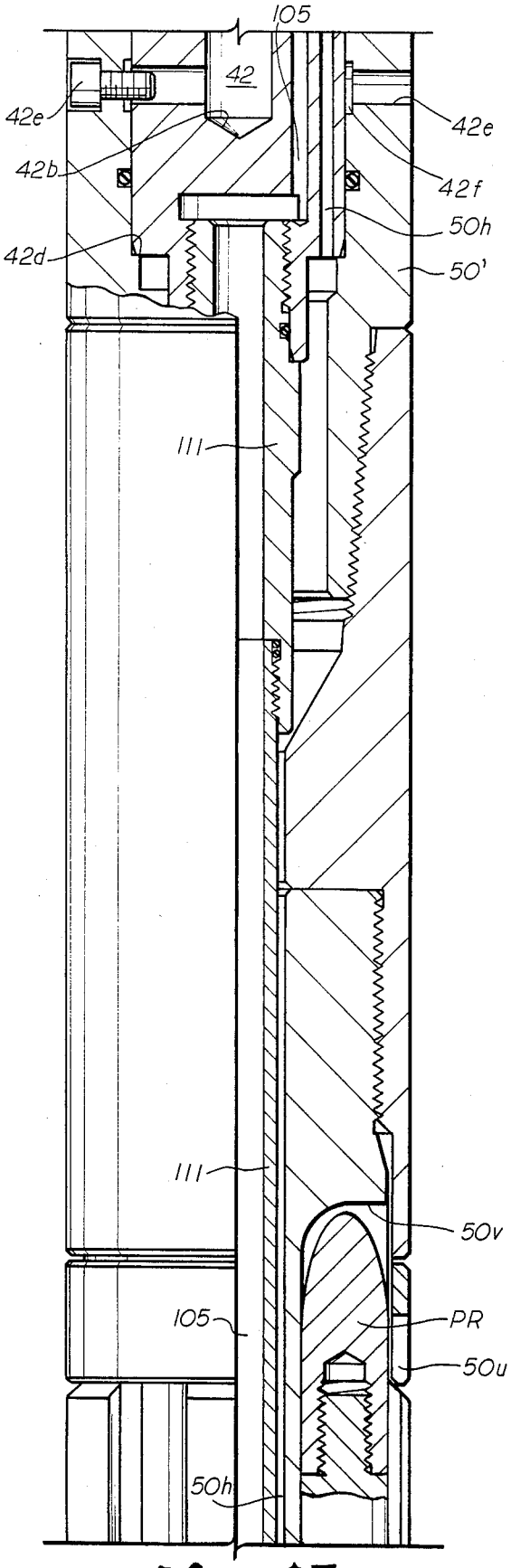
FIG. 15 is a continuation of FIG. 14, partially broken away at the upper end thereof to illustrate additional port and passage means for communicating with the well bore between the packers to the interior of the tool and a chamber for receiving a pressure recorder in the tool.

The first outer housing portion 40 is closed off internally as shown at 40a in FIG. 3, and the passage 41 in the housing portion 40 communicates with the longitudinal bore 42 in the tool T beneath the barrier 40a as shown in FIG. 3. The longitudinal bore 42 extends through the tool T to communicate with the well bore between the spaced packer elements 130 and 150 as shown in FIGS. 3–15 inclusive. More particularly, in FIG. 11, it will be noted that the internal bore 42 of the tool T extends through the tube 111 as shown in FIGS. 11–15 to terminate within the tube 111 as shown at 42b in FIG. 15. Ports 42e (FIGS. 14 and 15) circumferentially spaced in the outer housing 50' communicate with annular cavity 42f whereby the tool T may be communicated to the isolated zone between the packers 130 and 150 for testing or treatment thereof as will be described in greater detail hereinafter. Suitable means as shown at 42d may be employed for securing or seating the tube 111 in position in the housing portion 50 as shown in FIG. 15.

Figure 12:
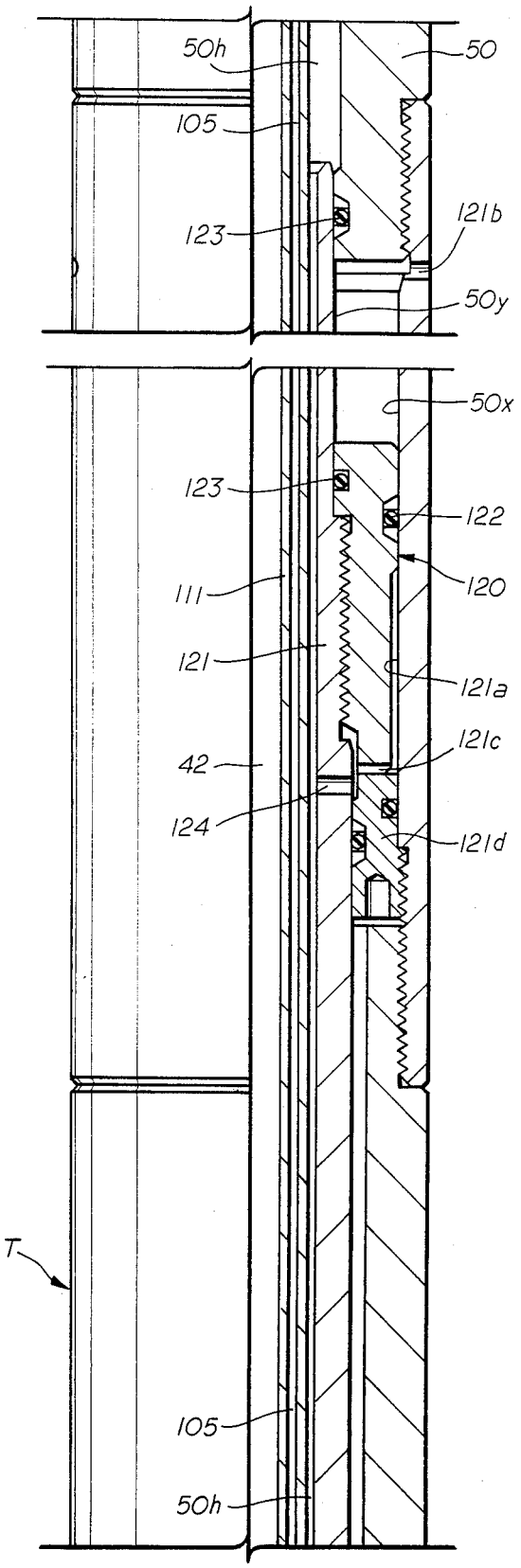
FIG. 12 is a continuation of FIG. 1 illustrating a piston means which is responsive to the hydraulic pressure created by the pump means for assisting in deforming the packer elements into sealing engagement with a well bore wall.

A part of the outer housing 50 upon which the packer elements or element is mounted is longitudinally movable to accomodate radial expansion and contraction thereof. Attention is directed to FIG. 12 wherein a first piston means referred to generally at 120 is secured to the longitudinally extending and movable sleeve 121 forming part of the outer housing 50. Suitable seal means as shown at 122 and 123 are provided on piston 120 for sealing between the wall 50x of the stationary outer housing 50 and wall 50y of the movable sleeve portion of housing 50, respectively. The sleeve 121 includes a port 124 which communicates with the hydraulic pressure passage 50h in body portion 50 for conducting fluid to cylinder 121a to move the piston means 120 as will be explained in greater detail. Passage 121b communicates cylinder 121 between seals 122 and 123 to the well bore to prevent a hydraulic lock. Shoulder 121c on annular member 121d retains sleeve 121 and housing 50 together. The longitudinally extending sleeve 121 is radially spaced from the tube means 111 to form therebetween the hydraulic pressure passage 50h from pump P as illustrated in the drawings.

Figure 13:
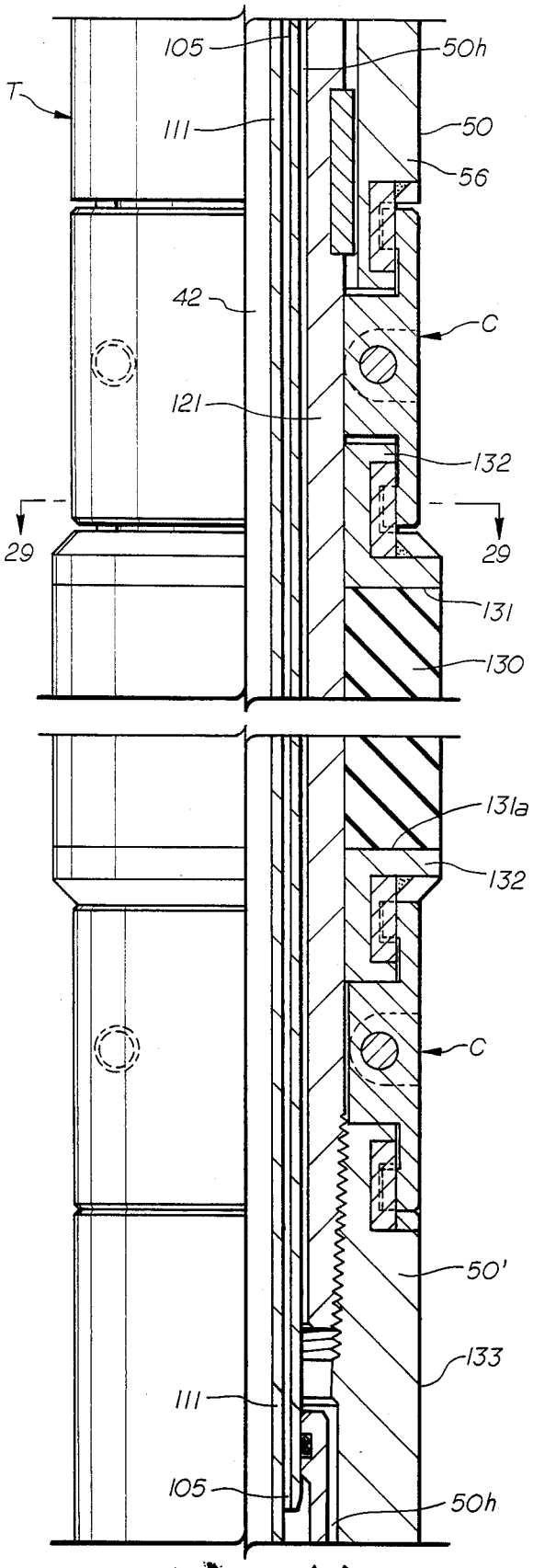
FIG. 13 is a continuation of FIG. 12 and illustrates the uppermost of the packer elements.
Figure 14:
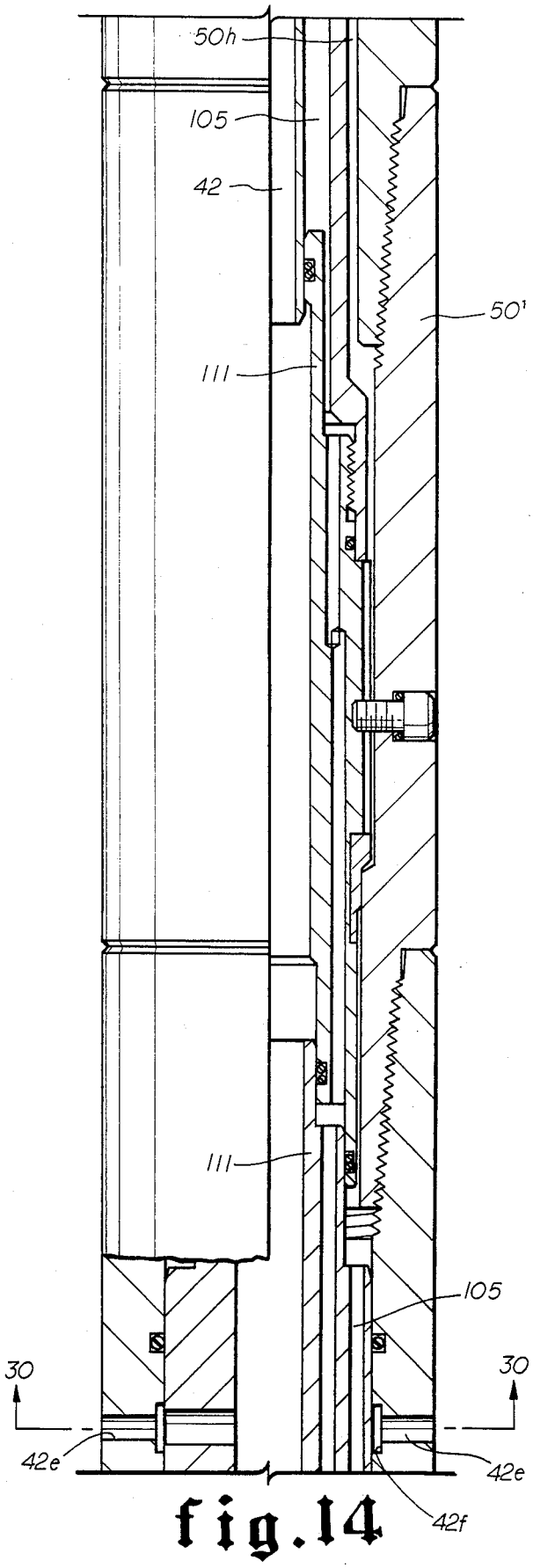
FIG. 14 is a continuation of FIG. 13, with the lower end thereof broken away on the line 14—14 of FIG. 30 to illustrate in greater detail a port and passage arrangement for communicating the well bore between the packers with the interior of the tool.

In FIG. 12, the sleeve 121 is slidably and sealably received in the lower end of outer housing 50 above the upper packer 130 shown in FIG. 13. The sleeve 121 extends longitudinally of the housing 50 and through upper packer element 130. The lower end 56 of stationary outer housing portion 50 is connected to the upper end 131 of packer 130 by the coupling C. The coupling C includes an annular member 132 which is bonded, or otherwise secured, to the upper end 131 of the upper packer 130, and the coupling C is a quick connect and disconnect arrangement well known to those skilled in the art. A similar annular member 132 is bonded, or otherwise secured, to the lower end 131a of the upper packer element, and a quick connect-disconnect coupling C is secured therewith and to the member 133 which in turn is threadedly connected with the sleeve 121 as shown in FIG. 13. The member 133 extends downwardly from its connection with sleeve 121 as shown in FIGS. 14–20 inclusive and is formed of various connections and components to provide the structure shown in the drawings. The member 133 terminates as shown at the top of FIG. 20 and is connected by quick connect-disconnect coupling C to the upper end 140 of lower packer member or element 150. The annular member 132 is bonded to the upper end 140 of packer element 150 and in turn is connected with the lower end of member 133 by the coupling C as shown in FIG. 20.

The sleeve 121 and member 133 forming part of housing 50 are movable longitudinally relative to the stationary housing portion 50, and the movable portions of housing 50 are designated 50' in FIGS. 13–22 of the drawings.

The member 133 may be formed in any manner and includes any number of components as shown. It terminates at its connection with the lower coupling C to the upper end of lower packer 150 as shown in FIG. 20.

Figure 19:
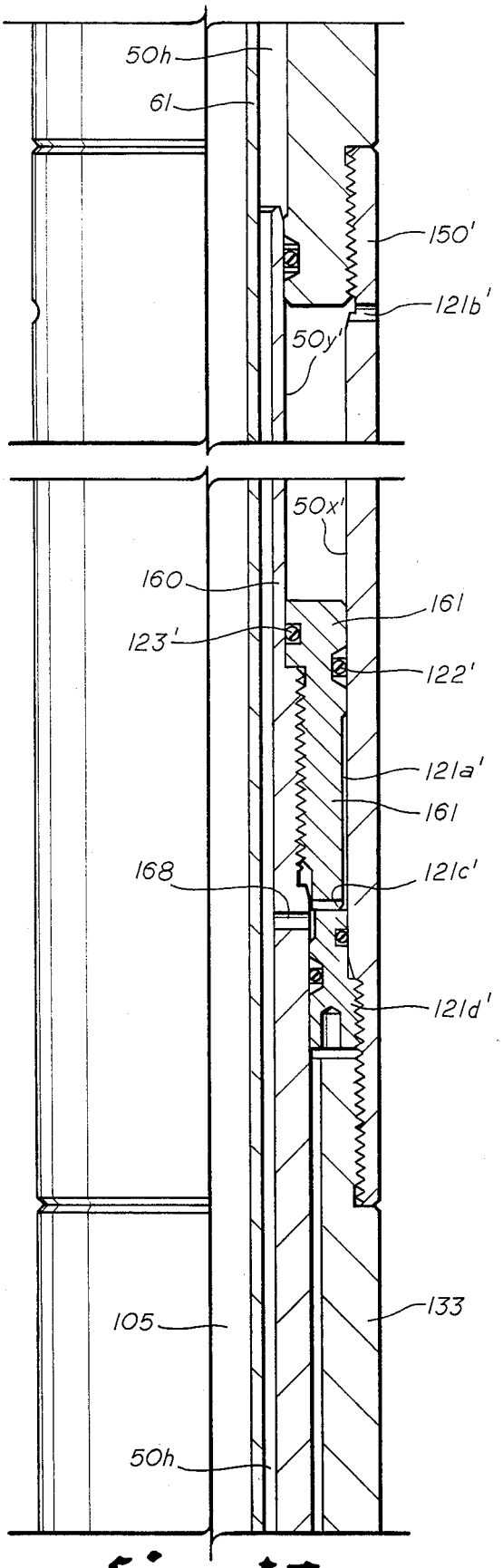
FIG. 19 is a continuation of FIG. 18 and illustrates additional piston means for receiving hydraulic pressure from the pump to assist in moving the packer elements into sealing engagement with the well bore wall.
Figure 22:
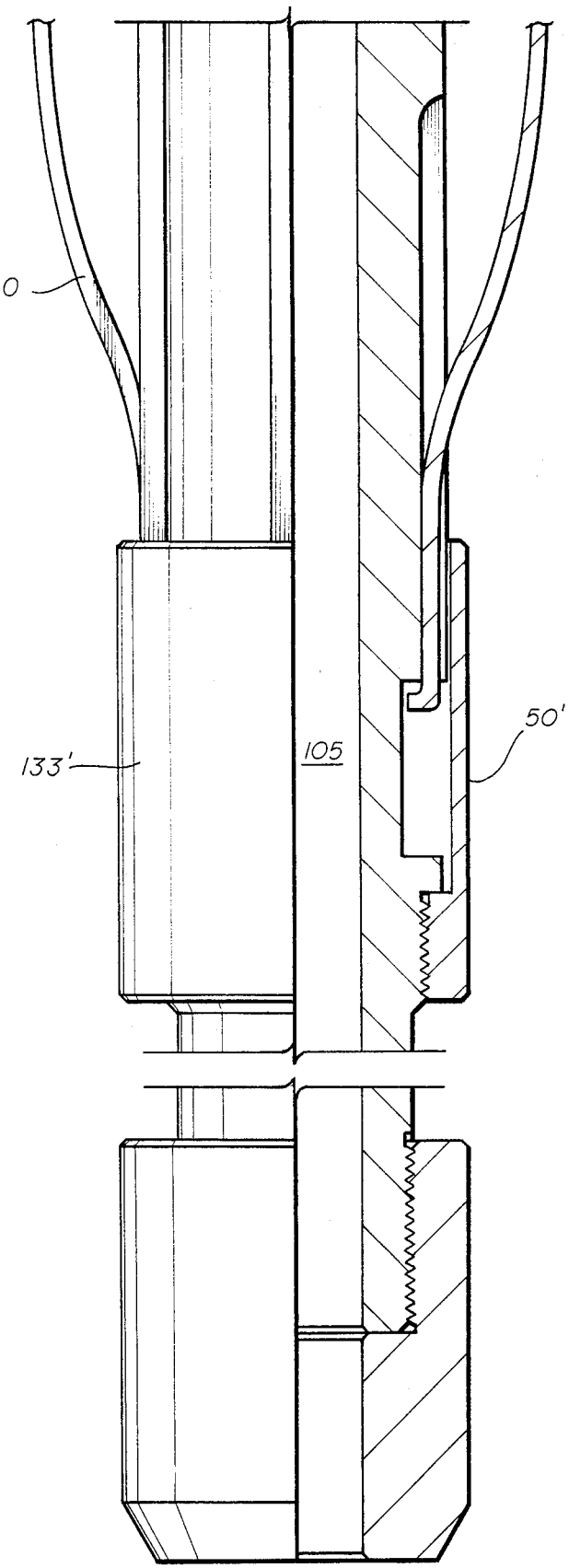
FIG. 22 is a continuation of FIG. 21 and shows the lower end of the tool.
Figure 23:
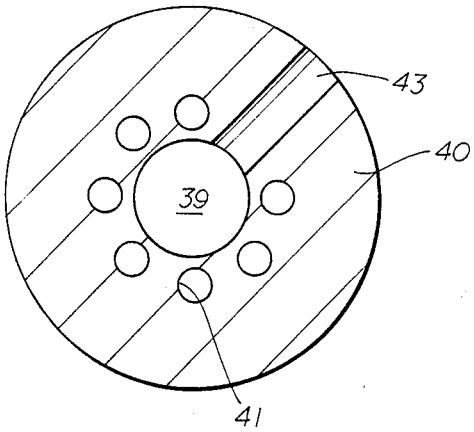
FIG. 23 is a sectional view on the line 23—23 of FIG. 3.
Figure 24:
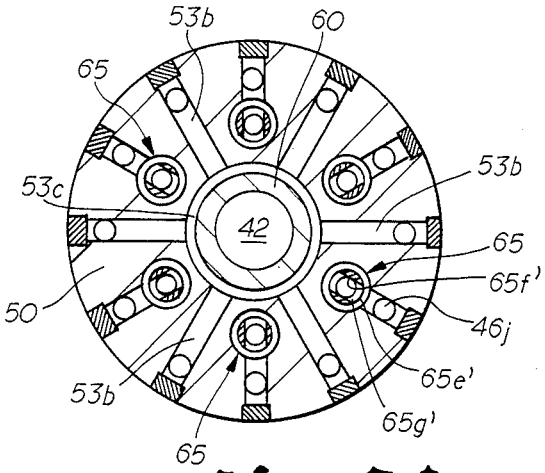
FIG. 24 is a sectional view on the line 24—24 of FIG. 8.

A second sleeve 160 which is similar in configuration to the first sleeve 121 and as shown in FIG. 19 is provided with an enlargement to form a second piston means 161 thereon having seals 122', 123' which engage the surfaces 50*x'* and 50*y'*, respectively. Suitable port means 168 are provided in the sleeve 160 for communicating the hydraulic pressure passage 50*h* with cylinder 121*a'*. The sleeve 160 is interlocked to the lower end of member 133 by the interlocking arrangement of the piston and cylinder as shown to accommodate movement of piston 161 in cylinder 121*a'*. Passage 121*b'* communicates cylinder 121*a'* between seals 122', 123' to the well bore. The sleeve 160 is secured to a member 133' in a manner that sleeve 121 is secured to member 133. Member 133' connects sleeve 160 to the lower end 140' of lower packer 150 by the coupling arrangement C which includes member 132 that is bonded to the lower end 140' of packer element 150. The part 133' of the second longitudinally movable sleeve 160 forms the lower part of outer movable housing portion 50' and provides support for the bow springs 1800 on the lower end of the tool T as shown in FIGS. 20–22, inclusive.

When hydraulic pressure is applied through the passage 50*h* from the pump P, it can be appreciated that it will be communicated to the ports 124, 168 to move the first and second piston means 120 and 161 longitudinally of the tool which applies a compressing force to the packer elements 130 and 150 for expanding them to sealably engage them with the well bore wall. When hydraulic pressure fluid is applied to the packer elements 130, 150, the outer housing 50 connected to the upper end of upper packer 130 remains stationary. Sleeve 121 and member 133 move up to compress and deform upper packer 130. Sleeve 160 and member 133' move up to compress and deform lower packer 150. The sleeves 121, 160 and member 133, 133' and the internal tool components therein are provided with suitable seals therebetween to accommodate relative longitudinal movement therebetween. The sleeves 121, 160 and connecting members such as 133, 133' and their components form an outer movable housing portion 50'.

The lower end portion of the tool T formed by member 133' is provided with bow spring means 1800 for engaging the well bore wall and restraining rotation of the outer housing 50 and 50' from where it begins in FIG. 7 through FIG. 22 as rotation is applied to the well string TM to rotate the hydraulic tool HT and housing portion 40 which rotate relative to the stationary outer housing 50 and operate pump P to discharge pressure fluid to expand the packer elements 130, 150.

The shifting sleeve valve 100 in FIG. 9 is provided to control communication. FIGS. 31A–31D inclusive illustrate certain structural arrangements of the shifting sleeve 100 and mandrel 60, and more particularly, it will be noted that the shifting sleeve 100 is provided adjacent its upper end with a plurality of circumferential recesses 1010 for receiving the ball 1020 therein. The mandrel 60 is provided with a key 60*d* which fits in keyway 75 that extends all the way through annular housing 76 which housing surrounds the mandrel 60 and extends between the mandrel 60 and the sleeve valve 100 as shown. The key 60*d* causes housing 76 to rotate with mandrel 60 and keeps the slot 60*e* aligned for receiving ball 1020. The longitudinally extending slot 60*e* is provided with sloping end surfaces 60*f* as shown, and the ball 1020 which fits in opening 76*a* of member 76 is aligned for engagement in the groove 60*e* for riding on the surface 60*g* of the mandrel, depending upon the longitudinal relationship of the mandrel 60 and the slot 60*f* therein to the opening 76*a*. A plurality of circumferentially spaced longitudinally extending grooves 100*a* (FIG. 9) is provided in the outer surface of sleeve valve 100 which overlap at their ends with the single groove 100*b*. Seal ring means 50*n* are provided in the outer housing 50 for sealing between the housing 50 and sleeve valve 100. Seal ring means 100*d* are provided in the shifting sleeve valve 100 for sealing engagement with the mandrel 60 as shown in FIG. 9.

When the sleeve valve 100 is in the down position as illustrated in FIG. 9, the plurality of circumferentially spaced longitudinally extending slots or grooves 100*a* span the seal means 50*n* and freely communicate hydraulic pump pressure with the passage 50*h* by reason of communication between grooves 100*a* and the annular recess 50*m* in the outer housing 50 as shown so that hydraulic pressure from the pump may be freely communicated to actuate the first and second piston means 121, 161 to deform or inflate packer elements 130, 150 for sealably engaging a well bore wall.

Port means 50*t* are provided in outer housing 50 and port means 100*g*, 100*h* are provided in the sleeve valve 100 and port means 60*k* are provided in the mandrel 60 to control communication as will be described in greater detail.

Figure 16:
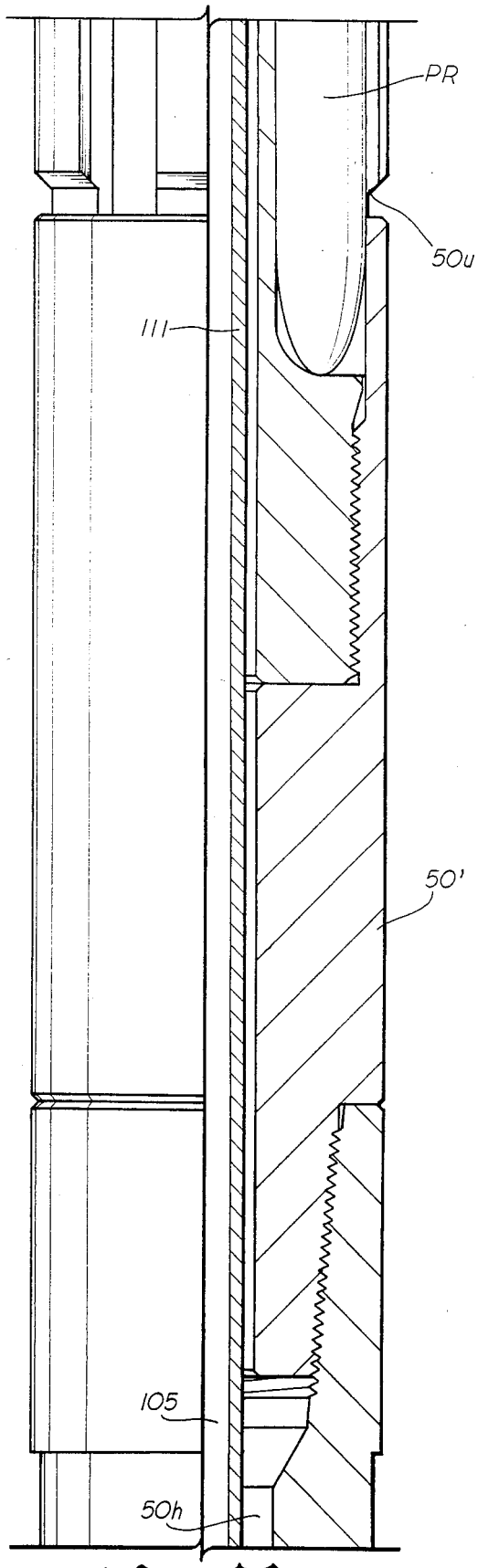
FIG. 16 is a continuation of FIG. 15.

Attention is directed to FIGS. 15 and 16 of the drawings wherein a longitudinal void 50*v* is provided in the outer housing which receives and retains in any suitable manner a pressure recorder PR, as shown in the drawings, to record the formation pressure in the well bore when desired, the well bore pressure being communicated to the pressure recorder by longitudinal void 50*v*.

From the time that the elements 130, 150 are deformed into initial contact with the well bore wall until the time that they take a fully deformed or set position thereagainst, a volume of fluid between the elements is displaced by such action. Suitable means are provided as illustrated in FIG. 17 for receiving, or collecting, the displaced fluid. Port 209 is provided in the movable outer housing portion 50' between packer elements 130, 150 as shown in FIG. 17.

Suitable sensing means for comparing the pressure in the isolated zone with the pressure in the well bore are provided which is responsive when the pressure in the isolated zone is less than the well bore pressure to increase the pressure acting to urge the packer elements into sealing engagement with the well bore wall to inhibit creep or movement of the elements along the well bore wall. The sensing means may assume any suitable form, and as shown is in the form of a movable barrier. The barrier includes an annular seating sleeve 211 which is threadedly secured at 212 to housing portion 50' and extends longitudinally to terminate in annular seat or enlargement 210 as shown which limits the longitudinal movement of second piston means 220. Suitable seal means 213 between the annular seating member 211 and housing portion 50' are provided.

A first piston means 215 is provided in the chamber or space 208 between the housing portion 50' and the sleeve 50'' threaded to housing 50' and spaced radially inwardly as shown in FIG. 17. The piston 215 is provided with seal means 216 for sealably engaging between housing portion 50' and sleeve 50''. Spring means 218 in chamber 208 and supported by housing 50' as shown in FIG. 18 normally urge piston means 215 upwardly in chamber 208 to the position illustrated in FIG. 17 of the drawings.

Second piston means 220 include an annular shoulder 221 which seats on the shoulder 214*a'* of housing portion 50' and is provided with a seal 219 which sealably and slidably engages the longitudinally extending seating member 211 to seal therebetween. An annular piston portion 221 is on the other end of the longitudinally and circumferentially extending portion 220*a* of the piston 220. Piston portion 221 is provided with suitable seal means 221*a* to engage sleeve.

In the running in position of the tool, the first piston means 215 and the second piston means 220 assume the position as shown in the drawings, and formed therebetween is the chamber 214, the first and second piston means being spaced at one end to form an annular passage 214*b* for communicating fluid between the chamber 214 to one side of the first piston means 215 in chamber 208 when piston 220 moves to prevent a hydraulic lock. This arrangement provides means to collect fluid displaced from the zone being isolated as the packers 130, 150 sealably expanded into engagement with the well wall and provides a means for maintaining the inflate hydraulic pressure in passage 50*h* at a pressure always above the well bore pressure to inhibit creep or crawl of the elements in the well bore as will be described.

OPERATION OF THE INVENTION

Figure 2:
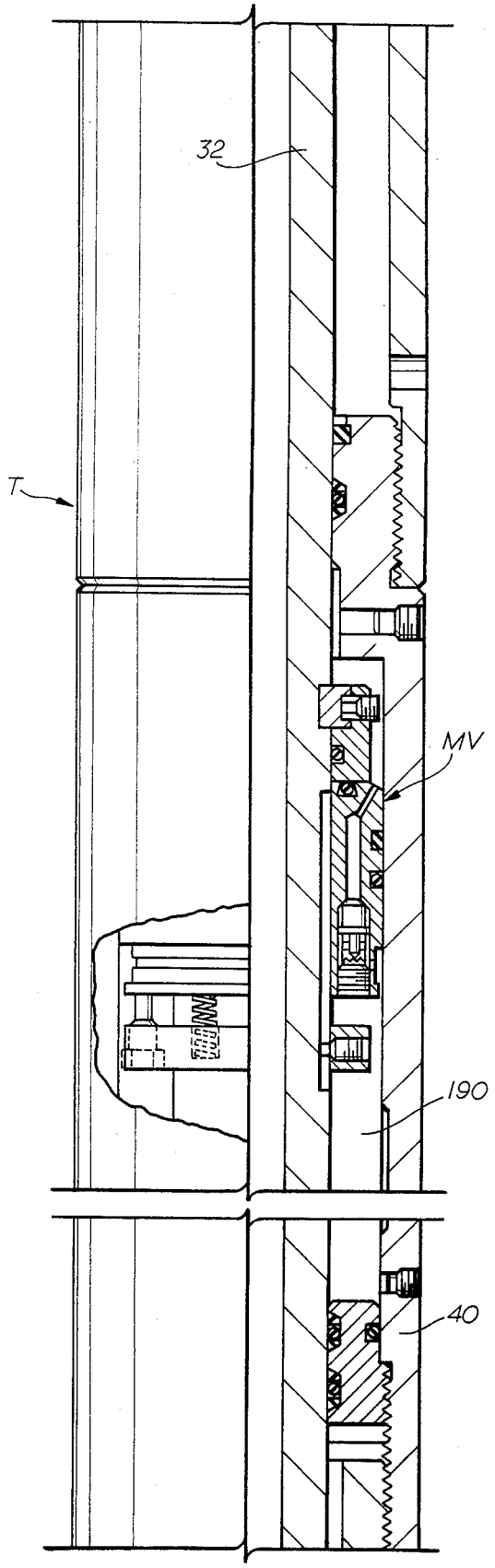
FIG. 2 is a continuation of FIG. 1 partially broken away to illustrate further structural details.

The tool is shown in the drawings in its running in position in a well bore. It can be appreciated that no well bore is illustrated; however, as well known to those skilled in the art, when the present invention is lowered on tubular member TM into the well bore, it is surrounded by the well bore. The hydraulic tool HT will assume the position shown in FIGS. 1–3 of the drawings wherein the barrier 37 closes off the tubular member TM above the hydraulic tool from communicating with the bore 42 in the tool T beneath the hydraulic tool. When it is desired to test or treat the isolated zone, lowering the tubular member TM opens the hydraulic tool HT and tubular member TM by aligning ports 36 and 38 to the bore 42 in the tool T. The bore 42 communicates through ports 42*e* with the isolated zone so that the test sample therefrom is received into an empty or substantially empty tubular member TM. It can be appreciated that well bore fluid will fill the chamber 52*a* and passage 53 which communicates to the pump intake cylinders 46*i* and pistons as shown in FIG. 8 as the tool is lowered into the well bore.

When the elevation has been reached in the well bore at which it is desired to isolate a zone, movement of the tubular member TM connected with the hydraulic tool HT at the threads 31 is effected to operate the pump P to cause upper and lower packers 130, 150 to sealably engage the well bore wall. The present invention will be described wherein the movement of the tubular member TM is by rotation. However, suitable pump means can be employed which actuates by reciprocation of the tubular member TM to actuate one or both of the packer elements. Also, it can be appreciated that in lieu of the squeeze packer elements 130, 150, inflatable elements could be as readily employed. In that event, the piston means 120, 161 would be eliminated and ports provided through the elements 121, 160 to communicate directly behind the inflatable packer elements for inflation thereof.

The present invention will be described wherein the tubular member TM is rotated, and wherein the packer elements 130, 150 are squeeze packer elements formed of elastomer and which are adapted to be expanded by deformation into sealing contact with a well bore wall when the hyraulic tool HT and connected member 32 are rotated along with outer housing member 40 by reason of the spline connections S shown in FIGS. 1, 4 and 5.

As previously noted, the upper housing portion 40 including the upper end of the tube or mandrel 60 threadedly engaged therewith as shown in FIG. 6 provide a chamber for receiving the upper end P' of the pump P. The pump end portion P' is an elongated extension which is locked to outer housing portion 40 by means of the spline S shown at the top of FIG. 7. This enables rotation to be imparted to the rotor 46 of pump P to effect reciprocating movement of the wobble plate 46*f*. The wobble plate 46*f* is restrained against rotation by radial extensions fitting in opposed longitudinally extending slots 301 in annular collar 300 carried by the outer housing member 50. As the rotor 46 of the pump P is rotated by rotation of the tubular member, the bearing means 46*e* on cam surface 46*d* engages the wobble plate and depresses it sequentially. As the rotor rotates thereabout and sequentially raises the wobble plate 46*f* so that the pistons 46*h* in the circumferentially space cylinders 46*i* are sequentially lowered and then raised so as to first draw fluid from the intake passage 53 into the cylinders 46*i* and then to discharge it from the cylinders under pressure into discharge passage 46*j*.

During rotation of the tubular member TM, rotation of the outer housing member 50 which receives and supports the lowermost of the pump means P as shown in FIG. 7 is restrained. This restraint is effected by means of the bow springs 1800 on the lower end of the outer housing portion 50' as shown in FIGS. 21 and 22. Thus, the housing portions 50 and 50' shown in FIGS. 7–22 including their various components are restrained against rotation while the rotor 46 of the pump P is rotated to move around and actuate the wobble plate 46*f* to reciprocate the pistons 46*h* in their respective cylinders 46*i*.

Attention is directed to FIG. 8 of the drawings. When the rotor 46 of the pump P is rotated to lift a piston, the suction in the check valve cover 65*i* in the check valve chamber 50*b* communicated with the cylinder and fluid from the well bore through passage 53 is discharged through port 65*h* into check valve chamber 50*b* above seals 65*d*. This liquid and fluid is then discharged through passage 46*i'* into cylinder 46*i*. It can be appreciated that spring 65*j* will maintain the check valve cover 65*i* seated to close off communication between 65*h* and the cylinder 46*i* until the piston in that cylinder is lifted by the wobble plate 46*f* in response to rotation of the rotor 46 and the cam surface 46*d* thereon. Thus, when one of the cylinders 46*i* is lifted, this will lift the check valve cover 65*i* off its seat and accommodate flow of liquid through port 65*h* to the bottom of such cylinder. Thereafter, as the wobble plate 46*f* causes such cylinder to move downwardly, the hydraulic fluid is discharged from the cylinder through passage 46*j* to the check valve 65*b* which pressure unseats the downwardly opening check valve cover 65*i'* for flow of fluid through port 65*h'* into annular chamber 46*k*. The fluid from all the cylinders is discharged into annular chamber 46*k* and from there it flows through annular cavity 53*d'* to the master check valve 90.

It can be appreciated that rapid rotation of the tubular member TM causes the cam surface 46*d* of rotor 46 to rapidly, sequentially move the pistons up and down to provide hydraulic pressure in chamber 46*k* which is effective to accomplish the intended function of causing elements 130, 150 to deform and sealably engage the well bore wall. The hydraulic pressure discharged to the top check valve of master check valve 90, as shown in the drawings, is then discharged through port 90*e* and lifts check valve cover 90*f* off its seat for discharge to the passage 50*g* which then communicates such fluid through the second check valve means 90″ by passing it through port 50*f*′, passage 90*d*′, port 90*e*′ and into passage 50*h*. This pressure fluid is then conducted through the passage means 50*h* shown in FIGS. 8–21. Port means 124 communicate passage means 50*h* with the cylinder 121*a* and piston means 120 as shown in FIG. 12 and passage means 168 communicates hydraulic pressure from passage 50*h* to cylinder means 121*a*′ and piston means 161 as shown in FIG. 19 to effect longitudinal movement of each of the pistons 121, 161 so that the member 133, 133′ connected therewith transmit pressure to act against the bottom annular edge of the packer means 130 and 150, respectively. This causes a deformation in the squeeze packer elements to cause them to expand and sealably engage the well bore wall.

When the packers 130, 150 initially engage the well bore wall, this traps fluid therebetween; however, the packers continue deformation and increase in volume in the isolated zone which reduces the size of the isolated zone as the packers assume their final set with the well bore wall. The fluid in the isolated zone which is displaced during this operation must be accommodated.

In FIG. 17, the fluid displaced from the isolated zone during this operation is discharged through the port 209 in outer housing portion 50′. Inflate pressure through passage 50*h* acts to move annular piston 220 downwardly which in turn moves annular piston 215 downwardly into space 208 as packers 130, 150 start to inflate and before they engage the well wall. This forms a chamber above piston 215 and defined by seal 221*a* on annular piston portion 221; seals 216 on annular piston 215; and seals 213, 219 as shown. As fluid is displaced from the isolated zone, it passes through port 209 and into this chamber and further moves piston 215 downwardly in space 208 as necessary. It will be noted that space 208 is of substantial longitudinal extent as shown in the drawings to accommodate movement of piston 215 therein. This volume of displaced liquid is retained in the annular chamber formed in 208 above the piston 215 and remains in the well tool T.

When the packers 130, 150 have been set against the well bore wall, and it is desired to take a test of the isolated zone therebetween, the mandrel 60 is lowered by lowering tubular member TM which lowers outer housing portion 40 and mandrel 60 relative to housing 50 which is now fixed in the well bore since the packer elements 130 and 150 thereon are sealably engaged with the well bore. When this occurs, the mandrel 60 moves from the position shown in FIG. 31D to the position shown in FIG. 31C. This downward movement of the tubular member opens the longitudinal bore in the hydraulic tool HT and in the tubular member TM to longitudinal passage 42 in the tool T and to the isolated zone in that member 32 by reason of the spline S in FIG. 1 telescopes into housing 40 and the port 36 in member 32 is aligned with the port 38 in housing 40 which communicates with the passage 41 in housing 40. Passage 41 communicates with the passage 42 around barrier 40*a* in housing 40. Passage 42 is closed at its lower end in tool T as illustrated at 42*b* in FIG. 15, but it communicates with the isolated zone between the expanded packers by means of the ports 42*e* shown at the bottom of FIG. 14 and top of FIG. 15.

When the hydraulic tool HT is thus opened, a flow test may be accomplished in the isolated zone between the expanded and sealed packers in a manner well known in the art since the isolated zone is communicated to the tubular member TM above the hydraulic tool by ports 42*e*, passage 42, passage 41 and ports 36, 38.

During such flow test, opening the annulus between the packers 130, 150 to the tubular member TM above the hydraulic tool HT causes the pressure in the well bore annulus or isolated zone between the packers to fall substantially below the well bore pressure acting on the bottom of piston 215. This substantial pressure differential tends to move piston 215 rapidly upwardly. However, due to the hydraulic and fluid pressure in passage 50*h* acting thereon, piston 221 has moved downwardly in chamber 214 as piston 215 moves downwardly when fluid is displaced from the annulus between the packers as they are expanded into set engagement with the well bore wall as previously described.

The pressure differential between the isolated annulus and well bore due to the decrease in pressure in the isolated annulus during a flow test or shutin test causes the piston 215 to move upward rapidly and thereby causes piston 221 to also move up rapidly pressurizing the hydraulic fluid in passage 50*h* which communicates with the piston means 120, 161 and thus increases the hydraulic pressure acting on such pistons to urge the packers 130, 150 into tighter sealing engagement with the well bore wall.

Similarly, when taking a shutin test, there generally will be a pressure differential between the isolated zone and well bore.

The foregoing arrangement provides a means to receive fluid displaced from the annulus between the packer elements 130, 150 as they sealingly engage the well bore wall. Such arrangement also is operable in response to the pressure differential between the hydrostatic pressure existing in the well bore and the pressure between the elements when sealingly engaged with the well bore wall to increase the hydraulic pressure acting on the elements. It can be appreciated that the pressure differential between the hydrostatic pressure in the well bore and the pressure between the elements when they are sealingly engaged with the well bore wall increases substantially during a flow test, but, as noted, there will also be a differential on a shut in test. In either case, the present invention broadly contemplates sensing means which automatically maintains the hydraulic pressure which urges the elements into well bore wall sealing and seating engagement above the hydrostatic pressure in the well bore. It also contemplates means to eliminate, or tend to eliminate, wall creep or movement of the packers during operations in the well bore. It can be appreciated that when the pressure in the annulus between the packers when they are in sealing engagement with the well bore decreases, the well bore pressure may tend to move the packers longitudinally along the well bore. The arrangement described hereinabove assists in overcoming this problem in that it is responsive to the well bore pressure and more particularly the differential between the well bore pressure and the pressure existing in the isolated annulus between the packers to increase the hydraulic pressure acting on the packer elements to maintain them in sealing engagement with the well bore wall. When the pressure in the isolated zone is less than the pressure in the well bore, the present invention may function to increase the pressure urging the packers into sealing engagement with the well bore wall. This arrangement functions as a sensing means to sense change in pressure between the zone and the well bore. It also functions to compare the pressure in the zone with well bore pressure, and to react in relation to the comparison to accomplish the purpose in inhibiting packer creep.

After the flow test has been completed, the tubular member TM may be picked up which raises the hydraulic tool HT to the position shown in FIG. 3 which misaligns ports 36 and 38. This closes the hydraulic tool and enables what is termed the "shut in test" to be performed. Generally, a second flow test is performed by again lowering the hydraulic tool to align ports 36 and 38 so that fluid from the well bore between the packers may be communicated to the production flow ports 42*e* to the longitudinally extending passage 42 and through the passage 41 through the ports 38, 36 and into the tubular member to the earth's surface. A desired number of shutin and flow tests may be thereafter conducted in a manner as above described.

If it is desired to isolate another zone in the well, or to remove the tool T from the well bore, the packers 130, 150 must be deflated. While the packers 130, 150 are still sealingly engaged with the well bore wall, the tubular member TM extending to the earth's surface is lowered to shift the hydraulic tool HT and mandrel 60 downwardly so that the mandrel 60 again assumes the position shown in FIG. 31C of the drawings.

Figure 31D:
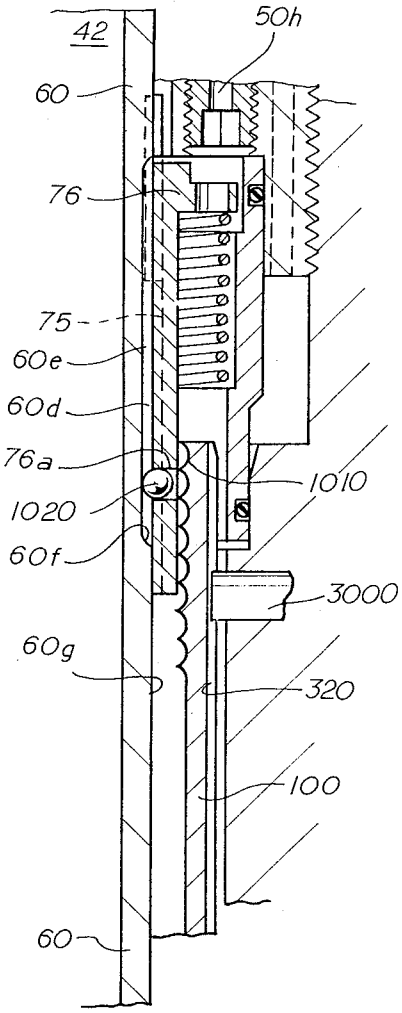
FIGS. 31A–31D are partial enlarged sectional views illustrating the sequencing of the shifting or sliding valve of FIG. 9 in greater detail.
Figure 31C:
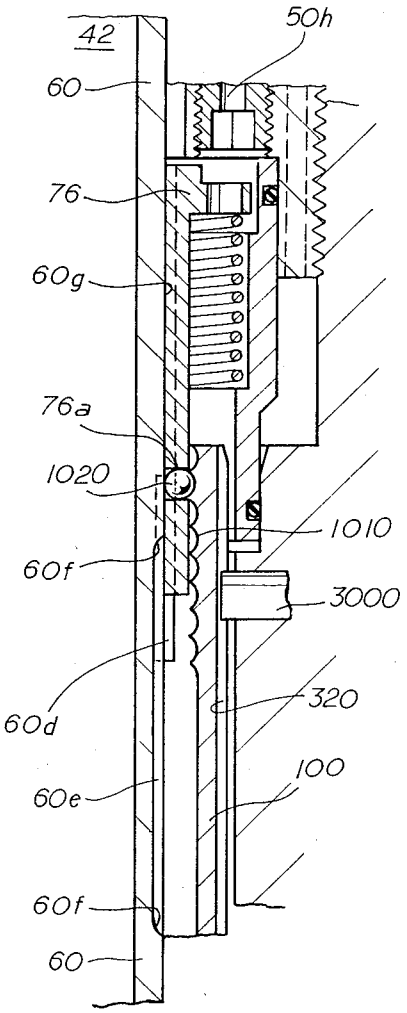

At this time, it will be noted that the ball 1020 has been moved from groove 60*e* by such lowering movement to engage it in opening 76*a* so that it projects into one of the annular grooves 1010 of the shifting sleeve 100 as shown in FIG. 31C. Since mandrel 60 is connected to annular member 76 by reason of the key 60*d* fitting in longitudinal keyway 75, rotation is imparted to attempt to rotate sleeve 100 since the ball 102 is engaged in hole 76*a* of stationary member 76. However, key 3000 carried by housing 50 fits in groove 320 of sleeve 100 and restrains the sleeve 100 from rotating so that attempted rotation of sleeve 100 by engagement as above described causes sleeve 100 to shift or travel. This moves the sleeve 100 upwardly to the position shown in FIG. 31B of the drawings. Since the mandrel has already been lowered, it is aligned with port 50*t* (FIG. 9) in outer housing 50. When sleeve 100 is then raised as above described, port 60*k* in the mandrel 60, port 100*g* in sleeve 100 and port 50*t* in outer housing 50 are aligned with each other. This communicates the well bore above the packers 130, 150 with the annulus between the expanded packer elements 130, 150 by communicating the well bore through the foregoing aligned ports and longitudinal passage 42 to the production ports 42*e* between spaced expanded packer elements 130, 150. This equalizes the pressure in the isolated annulus with the pressure in the well bore and the mandrel 60 is then moved to enable the hydraulic actuating fluid in passage 50*h* to be relieved from the expanded packers 130, 150.

When the sleeve 100 was raised as above described, port 100*h* therein was aligned with annular cavity 50*m* in passage 50*h*. Thus, when tubular member TM is raised, this raises the hydraulic tool HT and also raises the housing 40 and mandrel 60 connected therewith to align port 60*k* in the mandrel with port 100*h* in the sleeve 100 and annular cavity 50*m* which communicates with passage 50*h* in outer housing 50 so that the hydraulic pressure fluid acting to expand the packer elements is thus discharged into the passage 42. This enables the expanded packers to withdraw with engagement with the well bore, and the tool can either be removed from the well or repositioned in the well and further testing and/or treating operations conducted as desired.

In the running in position, the shifting valve 100 is in position to accommodate flow through the passage 50*h* to act on the piston means 120, 161. This is accomplished since the plurality of circumferentially spaced longitudinally extending slots 100*a* in the outer surface of sleeve 100 span the seal 50*n* in the outer housing 50 as shown in FIG. 9 and communicate fluid from above such seal to the annular space 50*m* which communicates with the laterally extending portion of passage 50*h* immediately below the seal means as shown in FIG. 9.

Figure 31B:
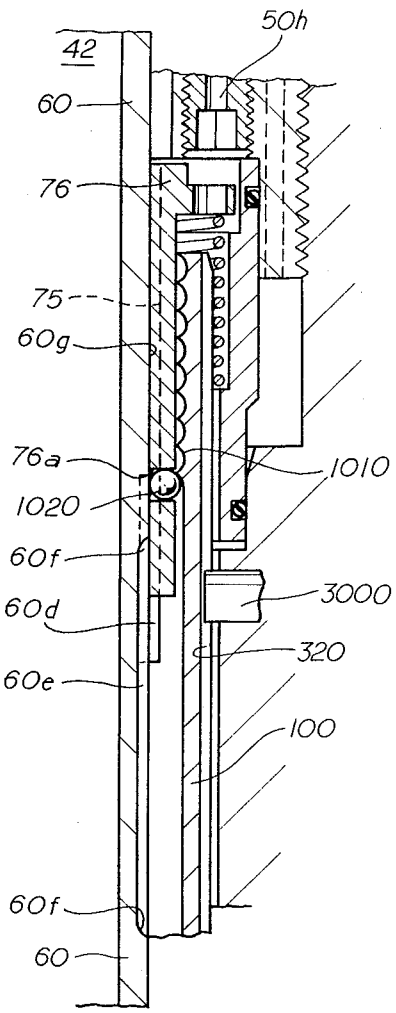
Figure 31A:
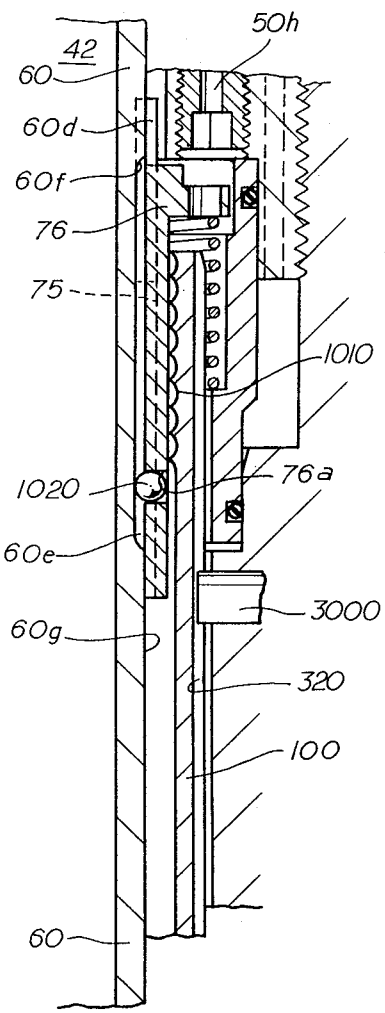

When the mandrel 60 is lowered to the position shown in FIG. 31C to force ball 102 to engage with the circumferential grooves in sleeve 100, rotation of the tubular member TM causes the sleeve 100 to shift upwardly to the position shown in FIG. 31B in which position the single longitudinally extending groove 100*b* is positioned to span the seal means 50*n* and to also position the circumferentially spaced grooves 100*a* above the seal 50*n*. Thus, communication in the hydraulic pressure passage 50*h* from above the seal 50*n* to the annular cavity 50*m* beneath the seal 50*n* is accomplished only through the single groove 100*b*, thus substantially restricting flow of hydraulic pressure fluid from the pump P to act to deform the packer elements into sealing engagement with the wall.

This restricted flow will cause a pressure differential across the area between seal 50*n* and seal 100*e* which will let the pump pressure move the sleeve 100 down as shown in FIG. 31D to position sleeve 100 so that the tool T may perform another series of tests at another zone or formation, as may be desired. The foregoing, or above procedure, is then repeated to effect the tests in a manner as desired.

The foregoing disclosure and description of the invention are illustrative and explanatory thereof, and various changes in the size, shape and materials as well as in the details of the illustrated construction may be made without departing from the spirit of the invention.

What is claimed is:

1. In a well tool adapted to be lowered on a tubular member in a well bore wherein the tool includes spaced packer elements and pump means operable in response to movement of the tubular member for providing pressure to urge the packer elements to sealingly engage the well bore wall and isolate a zone therein, the invention comprising:

a. means operable in response to a pressure differential between a higher hydrostatic pressure in the well bore and a lower pressure in the isolated zone between the elements when the elements are sealingly engaged with the well bore wall to increase the pressure acting on the elements; and b. means carried by the tool to collect fluid displaced from between the elements as they engage the well bore wall.

2. The invention of claim 1 wherein the means operable in response to the pressure differential and means to collect comprises:

a. passage means for communicating pressure between the spaced packer elements to the tool;

b. first piston means in the tool movable in response to the pressure between the spaced packer elements and to well bore pressure above or below the spaced elements; and c. second piston means responsive to the pump hydraulic pressure which urges the packer elements into well bore wall sealing engagement, said second piston means abutting said first piston means, said first piston means movable in response to well bore pressure when it exceeds the pressure in the isolated zone to move said second piston means and thereby increase the hydraulic pressure acting to urge the packer elements into sealing engagement.

3. In a well tool adapted to be lowered on a tubular member in a well bore wherein the tool includes spaced packer elements and pump means operable in response to movement of the tubular member for providing fluid pressure to urge the packer elements to sealingly engage the well bore wall and isolate a zone therein, the invention comprising:

a. means to maintain the pressure which urges the elements into well bore wall sealing engagement above a hydrostatic pressure in the well bore; and b. means carried by the tool to collect fluid displaced from between the elements as they sealingly engage the well bore wall;

c. means associated with the well tool responsive when a pressure in the zone falls below the pressure in the well bore to increase the pressure acting to urge the elements into well bore wall engagement; and d. means carried by the tool to withdraw the packer elements from sealing engagement with the well bore wall comprising means for communicating the well bore pressure with the pressure in the isolated zone to equalize the pressure in the isolated zone with the pressure in the well bore, said means for communicating comprising a sleeve valve slidably supported on the tool and shiftable from a first closed configuration in which communication is blocked between the isolated zone and the well bore upwards to an open second configuration in which well bore pressure is communicated to the isolated zone;

means for causing said sleeve valve to shift upwards in a direction opposite to a downwards motion of said tubular member to its second configuration, said means further including means for restraining relative rotational motion between said sleeve and said tool; and means for communicating the pressure which urges the elements into well bore wall sealing engagement with a hollow formed in the interior of the tool to release the pressure into the interior of the tool and allow the expanded packers to withdraw from engagement with the well comprising a passage means between said means to maintain the pressure and said hollow formed by raising the tubular member from a closed configuration in which communication between said means to maintain the pressure and said hollow is blocked to an open configuration in which pressure is communicated to release the pressure into said hollow.

4. In a well tool adapted to be lowered into a well bore on a tubular member wherein the tool includes spaced packer elements, the invention including:

a. pump means operable in response to movement of the tubular member for providing fluid pressure to urge the elements into sealing engagement with the well bore wall and isolate a zone therein; and b. means associated with the well tool to maintain the pressure which urges the elements into engagement with the well bore wall above a hydrostatic pressure in the well bore;

c. means associated with the well tool responsive when a pressure in the zone falls below the pressure in the well bore to increase the pressure acting to urge the elements into well bore wall engagement; and c. means carried by the tool to withdraw the packer elements from sealing engagement with the well bore wall comprising means for communicating the well bore pressure with the pressure in the isolated zone to equalize the pressure in the isolated zone with the pressure in the well bore, said means for communicating comprising a sleeve valve slidably supported on the tool and shiftable from a first closed configuration in which communication is blocked between the isolated zone and the well bore upwards to an open second configuration in which well bore pressure is communicated to the isolated zone;

means for causing said sleeve valve to shift upwards in a direction opposite to a downwards motion of said tubular member to its second configuration, said means further including means for restraining relative rotational motion between said sleeve and said tool; and means for communicating the pressure which urges the elements into well bore wall sealing engagement with a hollow formed in the interior of the tool to release the pressure into the interior of the tool and allow the expanded packers to withdraw from engagement with the well comprising a passage means between said means to maintain the pressure and said hollow formed by raising the tubular member from a closed configuration in which communication between said means to maintain the pressure and said hollow is blocked to an open configuration in which pressure is communicated to release the pressure into said hollow.

5. In a well tool adapted to be lowered into a well on a tubular member wherein the tool includes spaced packer elements, the invention including:

a. pump means operable in response to movement of the tubular member for providing fluid pressure to urge the elements into sealing engagement with the well bore wall to isolate a zone; and b. sensing means associated with the well tool responsive to a pressure differential between a higher hydrostatic pressure in the well bore and a lower pressure in the isolated zone to increase the hydraulic pressure acting on the elements.

6. In a well tool adapted to be lowered into a well bore on a tubular member, the invention including:

a. spaced squeeze packer elements;

b. pump means operable in response to movement of the tubular member for providing fluid pressure to urge the elements into sealing engagement with the well bore wall to isolate a zone therein; and c. means associated with the well tool responsive when the pressure in the zone falls below the pressure in the well bore to increase the pressure acting to urge the elements into well bore wall engagement.

7. The invention of claims 4 or 6 including means to collect fluid displaced from the zone as the elements sealingly engage the well bore, said means to collect fluid including a variable volume chamber in the tool communicating with the well bore in the zone, and barrier means movable in response to displacement of fluid from the zone to vary the chamber volume.

8. The invention of claims 4, 5 or 6 including means to selectively communicate with the well bore the hydraulic pressure which urges the packer elements into sealing engagement with the well bore wall whereby the packer elements may withdraw from engagement with the well bore wall, said means including means to equalize the pressure between the packer elements with the well bore.

9. The invention of claims 4, 5 or 6 wherein the pump means comprises a wobble plate, a plurality of circumferentially spaced rods connected to said wobble plate, a piston connected to each rod, with each piston being sealingly received in a cylinder, a rotor connected to the tubular member and rotatable therewith, a cam surface on said rotor and contacting said wobble plate so that upon rotation of the tubular member, said wobble plate sequentially pulls each of said pistons up in its respective cylinder to bring hydraulic fluid into the cylinders and then sequentially pushes each of said pistons down in its respective cylinder to discharge hydraulic fluid therefrom under pressure.

10. In a well tool adapted to be supported on a tubular member in a well for isolating a zone in the well, the invention including:

a. a pressure recorder supported by the tool for recording fluid pressure in the zone to be isolated;

b. spaced packer elements carried by the tool;

c. pump means operable in response to movement of the tubular member for providing fluid pressure to urge the packer elements to sealingly engage the well wall;

d. means associated with the well tool responsive when the pressure in the zone falls below the pressure in the well bore to increase the hydraulic pressure acting to urge the elements into well bore wall engagement;

e. there being passage means in the tool communicating the well below the lowermost packer element with the well above the uppermost packer element to substantially equalize the pressure in the well above and below the elements;

f. there being additional passage means in the tool to communicate with the well in the isolated zone;

g. means for selectively opening the additional passage means to the tubular member on which the tool is supported for testing or treating the isolated zone; and h. means to equalize the pressure in the well bore above said spaced packer elements.

11. In a well tool adapted to be supported on a tubular member in a well for isolating at least one zone in the well, the invention including:

a. a pressure recorder supported by the tool for recording fluid pressure in the zone to be isolated;

b. spaced packer elements carried by the tool;

c. pump means operable by movement of the tubular member for providing fluid pressure to urge the packer elements to sealingly engage the well wall and isolate a zone therein;

d. means to increase the pressure which urges the elements into well wall engagement when the pressure in the zone falls below the well bore pressure;

e. there being passage means in the tool communicating the well below the lowermost packer element with the well above the uppermost packer element to substantially equalize the pressure in the well above and below the tool;

f. there being additional passage means in the tool to communicate with the well in the isolated zone; and g. means for selectively opening the additional passage means to the tubular member on which the tool is supported for testing or treating the isolated zone.

12. The invention of claims 10 or 11 wherein said packer elements are squeeze packers and wherein longitudinally spaced piston means are carried by the tool which are responsive to the pressure provided by said pump means to exert a longitudinal force on said squeeze packer elements to deform them outwardly into contact with the well wall.

13. The invention of claims 10 or 11 including means to collect fluid displaced from between the elements as they sealingly engage the well bore.

14. The invention of claims 10 or 11 wherein said pump means comprises a wobble plate type pump having a plurality of circumferentially spaced rods connected to said wobble plate, a piston connected to each rod with each piston being sealingly received in a cylinder, a rotor connected to the tubular member and rotatable therewith, a cam surface on said rotor and contacting said wobble plate so that upon rotation of the tubular member, said wobble plate sequentially pulls each of said pistons up in its respective cylinder to bring hydraulic fluid into the cylinders and then sequentially pushes each of said pistons down in its respective cylinder to discharge hydraulic fluid therefrom under pressure; and wherein the well tool includes longitudinally spaced piston means that are carried by the tool which are responsive to the hydraulic pressure provided by said pump means to exert a longitudinal force on said squeeze packer elements to deform them outwardly into contact with the well wall.

15. The invention of claims 6, 10 or 11 wherein the means responsive to increase the pressure acting to urge the elements includes means to collect fluid displaced from the zone as the elements sealingly engage the well bore, said means to collect fluid including fluid passage means in the tool communicating with the well bore between the spaced elements and a chamber in the tool communicating with said passage means, first piston means in the chamber having one end exposed to the pressure in the isolated zone and its other end exposed to the well bore pressure, and second piston means communicated with the pressure which urges the elements, said second piston means movable by said first piston means when the well bore pressure is greater than the pressure in the isolated zone to increase the pressure acting to urge the packer elements into sealing engagement.

16. In a well tool adapted to be lowered on a tubular member into a well for isolating at least one zone in the well:

a. at least one packer element carried by the tool;
b. pump means connected with the tool and operable upon movement of the tubular member to pump fluid to urge the packer element to sealingly engage the well wall and thereby isolate a zone in the well;
c. means to increase the pressure which urges the element into well wall engagement when the pressure in the zone falls below the well bore pressure;
d. there being passage means in the tool that communicates with the well in the isolated zone; and
e. means for opening the passage means in the tool to the tubular member on which the tool is supported for performing desired operations in the isolated zone.

17. The invention of claim 16 wherein said packer element is a squeeze packer.

18. The invention of claim 16 including valve means to open and close the passage means.

19. In a well tool adapted to be supported on a tubular member in a well bore wherein the tubular member includes spaced packer elements and pump means operable by movement of the tubular member for providing hydraulic pressure to urge the packer elements to sealingly engage the well bore wall to isolate a zone, the invention including:

a. means associated with the tool to inhibit creep of the packer elements along the well bore wall, said means to inhibit creep responsive to a higher pressure in the well bore and a lower pressure in the isolated zone; and
b. means carried by the well tool to collect fluid displaced from between the elements as they engage the well bore wall.

20. A method of testing or treating a well comprising the steps of:

a. lowering a tubular member with a tool having packer means thereon into a well;
b. moving the tubular member to create a pressure to urge the packer means to sealingly engage the well wall and isolate a zone therein:
c. increasing the pressure acting on the packer means when the pressure in the zone falls below the pressure in the well to inhibit creep of the packer means along the well wall; and
d. communicating the tubular member with the isolated zone for performing desired operations in the isolated zone.

21. In a method of testing or treating a well, the steps comprising:

a. lowering a tubular member with a tool thereon which has spaced packer means into the well;
b. moving the tubular member for providing fluid pressure to urge the packer elements to sealingly engage the well wall and isolate a zone therebetween; and
c. increasing the pressure acting on the packer means when the pressure in the zone falls below the pressure in the well bore to inhibit creep of the packer elements along the well wall.

22. The method of claims 20 or 21 including the steps of collecting fluid displaced from the isolated zone as the packer means sealingly engage the well bore wall.

23. A method of testing or treating a well comprising the steps of:

a. lowering a tubular member with a tool thereon which has at least one packer thereon into a well to form an isolated zone;
b. moving the tubular member to create fluid pressure to urge the packer element to sealingly engage the well wall and isolate a zone therein;
c. maintaining the pressure which urges the element into sealing engagement with the well wall above a hydrostatic pressure in the well;
d. increasing the pressure acting to urge the element into sealing engagement with the well wall when a pressure in the zone falls below the pressure in the well;
e. shifting a sleeve valve slidably supported on the tool upwards with nonrotary motion from a closed configuration in which communication is blocked between the isolated zone and the well to an open second configuration in which well pressure is communicated to the isolated zone responsive to a lowering of the tubular member; and
f. raising the tubular member to discharge the pressure which urges the element into sealing engagement.

24. The method of claim 23 including the step of collecting fluid displaced from the isolated zone as the packer element sealingly engages the well bore wall.

25. In a well tool adapted to be lowered on a tubular member into a well for isolating at least one zone in a well, the invention including:

a. spaced squeeze packer elements carried by the tool;
b. longitudinally spaced piston means carried by the tool;
c. pump means connected with the tool and operable upon movement of the tubular member to provide pressure which moves said piston means along the tool to exert a longitudinal compressing force on said packer elements to deform them into sealing engagement with the well wall to isolate a zone in the well bore;
d. means associated with the tool responsive when a pressure in the isolated zone falls below a pressure in the well bore to increase the pressure acting on said piston means and increase the compressing force on said elements to inhibit creep of said packer elements along the well wall while engaged therewith;
e. passage means in the tool for communicating with the isolated well zone; and
f. valve means for controlling communication of the passage means with the isolated zone through the tubular member to the earth's surface.

26. In a well tool adapted to be lowered on a tubular member into a well for isolating at least one zone in the well:

a. squeeze packer means carried by the tool;
b. longitudinally movable piston means connected to said packer means and carried by the tool, said piston means for transmitting pressure to said packer means in order to deform said packer means;
c. pump means connected with the tool and operable upon movement of the tubular member to provide pressure against said piston means for movement along the tool whereby said squeeze packer means is deformed into said sealing engagement with the well wall to isolate a zone therein; and
d. means associated with the tool responsive when a pressure in the isolated zone falls below a pressure in the well to increase the pressure acting against said piston means and increase the deformation of said squeeze packer means to inhibit creep of said packer means along the well wall while engaged therewith.

27. The invention of claim 26 wherein the means to prevent creep includes means to collect fluid displaced from the zone as the elements sealingly engage the well bore, said means to collect fluid including fluid passage means in the tool communicating with the well bore between the spaced elements and a chamber in the tool communicating with said passage means, first piston means in the chamber having one end exposed to the pressure in the isolated zone and its other end exposed to the well bore pressure, and second piston means communicated with the pressure which urges the elements, said second piston means movable by said first piston means when the well bore pressure is greater than the pressure in the isolated zone to increase the pressure acting to urge the packer elements into sealing engagement.

28. In a well tool adapted to be supported on a tubular member in a well bore wherein the tubular member includes spaced packer elements and pump means operable in response to movement of the tubular member for providing pressure to urge the packer elements to sealingly engage the well bore wall and isolate a zone, the invention including:

means to inhibit creep of the packer elements along the well bore wall when the pressure in the zone falls below the pressure in the well bore, said means to inhibit creep including:

chamber means to collect fluid displaced from the zone as the packers inflate to sealingly engage the well bore wall;

first piston means sealably carried by the tool and having one end exposed to the pressure in the chamber between the packer elements and its other end exposed to the pressure in the well bore; and second piston means responsive to the pump hydraulic pressure which urges the packer elements into well bore wall sealing engagement, said second piston means abutting said first piston means in the chamber, said first piston means movable in response to the well bore pressure when it exceeds the pressure in the isolated zone to move said second piston means and thereby increase the hydraulic pressure acting to urge the packer elements into sealing engagement.

29. A method of testing or testing a well comprising the steps of:

a. lowering a tubular member with a tool having packer means thereon into a well;

b. moving the tubular member to create a pressure to expand urge the packer means to sealingly engage the well wall for isolating a zone in the well;

c. comparing the well bore pressure with the pressure in the isolated well zone; and d. increasing the pressure acting on the packer means when the pressure in the well exceeds the pressure in the isolated well zone.

30. The method of claim 29 including the step of communicating the tubular member with the isolated zone for performing desired operations in the isolated zone.

31. In a well tool adapted to be lowered into a well bore on a tubular member wherein the tool includes spaced packer elements, the invention including:

a. pump means operable in response to movement of the tubular member for providing fluid pressure to urge the elements into sealing engagement with the well bore wall and isolate a zone therein; and b. means associated with the well tool to maintain the pressure which urges the elements into engagement with the well bore wall above the hydrostatic pressure in the well bore; said means associated with the well tool including means to collect fluid displaced from the zone as the elements sealingly engage the well bore, said means to collect fluid including fluid passage means in the tool communicating with the well bore between the spaced elements and a chamber in the tool communicating with said passage means, first piston means in the chamber having one end exposed to the pressure in the isolated zone and its other end exposed to the well bore pressure, and second piston means communicated with the pressure which urges the elements, said piston means movable by said first piston means when the well bore pressure is greater than the pressure in the isolated zone to increase the pressure acting to urge the packer elements into sealing engagement.

32. In a well tool adapted to be lowered into a well bore on a tubular member wherein the tool includes spaced packer elements, the invention including:

a. pump means operable in response to movement of the tubular member for providing fluid pressure to urge the elements into sealing engagement with the well bore wall and isolate a zone therein; and b. means associated with the well tool to maintain the pressure which urges the elements into engagement with the well bore wall above the hydrostatic pressure in the well bore; and c. means to collect fluid displaced from the zone as the elements sealingly engage the well bore, said means to collect fluid including a variable volume chamber in the tool communicating with the well bore in the zone, and barrier means movable in response to displacement of fluid from the zone to vary the chamber volume.

33. In a well tool adapted to be lowered on a tubular member into a well for isolating at least one zone in a well, the invention including:

a. spaced squeeze packer elements carried by the tool;

b. longitudinally spaced piston means carried by the tool;

c. pump means connected with the tool and operable upon movement of the tubular member to provide pressure which moves said piston means along the tool to exert a longitudinal compressing force on said packer elements to deform them into sealing engagement with the well wall to isolate a zone in the well bore;

d. means to inhibit creep of said packer elements along the well wall while engaged therewith, said means to inhibit creep including means to increase the pressure acting to urge said elements into engagement with the well bore wall when the pressure in the isolated zone falls below the well bore pressure;

e. passage means in the tool for communicating with the isolated well zone; and f. valve means for controlling communication of the passage means with the isolated zone through the tubular member to the earth's surface.

34. In a well tool adapted to be lowered on a tubular member into a well for isolating at least one zone in a well, the invention including:

a. spaced squeeze packer elements carried by the tool;

b. longitudinally spaced piston means carried by the tool;

c. pump means connected with the tool and operable upon movement of the tubular member to provide pressure which moves said piston means along the tool to exert a longitudinal compressing force on said packer elements to deform them into sealing engagement with the well wall to isolate a zone in the well bore;

d. means to inhibit creep of said packer elements along the well wall while engaged therewith, said means to prevent creep including means to collect fluid displaced from the zone as the elements sealingly engage the well bore, said means to collect fluid including fluid passage means in the tool communicating with the well bore between the spaced elements and a chamber in the tool communicating with said passage means, first piston means in the chamber having one end exposed to the pressure in the isolated zone and its other end exposed to the well bore pressure, and second piston means communicated with the pressure which urges the elements, said second piston means movable by said first piston means when the well bore pressure is greater than the pressure in the isolated zone to increase the pressure acting to urge the packer elements into sealing engagement;

e. passage means in the tool for communicating with the isolated well zone; and f. valve means for controlling communication of the passage means with the isolated zone through the tubular member to the earth's surface.

35. A method of testing or treating a well comprising the steps of:

a. lowering a tubular member with a tool thereon which has at least one packer thereon into a well to form an isolated zone;

b. moving the tubular member to create fluid pressure to urge the packer element to sealingly engage the well wall and isolate a zone therein;

c. maintaining the pressure which urges the element into sealing engagement with the well wall above a hydrostatic pressure in the well;

d. comparing a pressure in the isolated zone with the pressure in the well;

e. increasing the fluid pressure urging the packer element into sealing engagement with the well wall when the pressure in the isolated zone falls below the pressure in the well;

f. shifting a sleeve valve slidably supported on the tool upwards with nonrotary motion from a closed configuration in which communication is blocked between the isolated zone and the well to an open second configuration in which well pressure is communicated to the isolated zone responsive to a lowering of the tubular member; and g. raising the tubular member to discharge the pressure which urges the element into sealing engagement.

36. In a well tool adapted to be lowered on a tubular member in a well bore wherein the tool includes spaced packer elements and pump means operable in response to movement of the tubular member for providing fluid pressure to urge the packer elements to sealingly engage the well bore wall and isolate a zone therein, the invention comprising:

a. means associated with the tool to maintain the pressure which urges the elements into well bore wall sealing engagement above a hydrostatic pressure in the well bore;

b. means operable in response to a pressure differential between the higher hydrostatic pressure in the well bore and a lower pressure in the isolated zone between the elements when the elements are sealingly engaged with the well bore wall to increase the pressure acting on the elements; and c. means carried by the tool to collect fluid displaced from between the elements as they sealingly engage the well bore wall, and wherein said said means operable in response to a pressure differential and said means to collect include passage means for communicating pressure between the spaced packer elements to the tool, first piston means in the tool movable in response to the pressure between the spaced packer elements and to well bore pressure above or below the spaced elements, and second piston means responsive to the pump hydraulic pressure which urges the packer elements into well bore wall sealing engagement, said second piston means abutting said first piston means, said first piston means movable in response to well bore pressure when it exceeds the pressure in the isolated zone to move said second piston means and thereby increase the hydraulic pressure acting to urge the packer elements into sealing engagement.

37. In a well tool adapted to be lowered on a tubular member into a well for isolating at least one zone in the well:

a. squeeze packer means carried by the tool;

b. longitudinally movable piston means connected to said packer means and carried by the tool, said piston means for transmitting pressure to said packer means in order to deform said packer means;

c. pump means connected with the tool and operable upon movement of the tubular member to provide pressure against said piston means for movement along the tool whereby said squeeze packer means is deformed into said sealing engagement with the well wall to isolate a zone therein; and d. means associated with the tool to inhibit creep of said packer means along the well wall while engaged therewith, said means to inhibit creep including means to increase the pressure acting to urge said elements into engagement with the well bore wall when the pressure in the isolated zone falls below the well bore pressure.

* * * * *